US012716207B2

(12) United States Patent
Umeda

(10) Patent No.: US 12,716,207 B2
(45) Date of Patent: Aug. 25, 2026

(54) CONSTRUCTION MACHINE AND ASSISTING DEVICE FOR CONSTRUCTION MACHINE

(71) Applicant: SUMITOMO CONSTRUCTION MACHINERY CO., LTD., Tokyo (JP)

(72) Inventor: Takashi Umeda, Chiba (JP)

(73) Assignee: SUMITOMO CONSTRUCTION MACHINERY CO., LTD., Tokyo (JP)

( * ) Notice: Subject to any disclaimer, the term of this patent is extended or adjusted under 35 U.S.C. 154(b) by 149 days.

(21) Appl. No.: 18/468,008

(22) Filed: Sep. 15, 2023

(65) Prior Publication Data

US 2024/0035257 A1 Feb. 1, 2024

Related U.S. Application Data

(63) Continuation of application No. PCT/JP2022/013323, filed on Mar. 22, 2022.

(30) Foreign Application Priority Data

Mar. 22, 2021 (JP) ..... 2021-047745

(51) Int. Cl.
*E02F 9/26* (2006.01)
*E02F 9/20* (2006.01)

(52) U.S. Cl.
CPC ..... *E02F 9/262* (2013.01); *E02F 9/2033* (2013.01)

(58) Field of Classification Search
CPC ..... E02F 3/435; E02F 9/2033; E02F 9/205; E02F 9/2054; E02F 9/261; E02F 9/262; G06T 19/20; G06T 2219/2004
See application file for complete search history.

(56) References Cited

U.S. PATENT DOCUMENTS

| | | | | |
|---|---|---|---|---|
| 9,113,047 | B2 * | 8/2015 | Onuma | E02F 9/24 |
| 10,642,267 | B2 * | 5/2020 | Agarwal | B60W 50/14 |
| 10,876,275 | B2 | 12/2020 | Yamazaki et al. | |
| 10,920,403 | B2 * | 2/2021 | Izumikawa | E02F 9/24 |
| 11,111,654 | B2 * | 9/2021 | Hiekata | E02F 9/265 |

(Continued)

FOREIGN PATENT DOCUMENTS

| | | |
|---|---|---|
| JP | 2008-163719 | 7/2008 |
| JP | 2008-248613 | 10/2008 |

(Continued)

OTHER PUBLICATIONS

International Search Report for PCT/JP2022/013323 mailed on May 31, 2022.

*Primary Examiner* — Tyler J Lee
(74) *Attorney, Agent, or Firm* — IPUSA, PLLC

(57) ABSTRACT

An assisting device for a construction machine that provides assistance on work performed by the construction machine includes a processor; and the processor may acquire feature data which is data concerning a position of a predetermined feature existing at a construction site based on an output from a space recognition device; and associate, based on the feature data, position information with respect to the construction site with data concerning the position of the feature to generate combined data, the position information with respect to the construction site being determined in a coordinate reference system that is different from a coordinate system with respect to a shovel.

20 Claims, 16 Drawing Sheets

(56) References Cited

U.S. PATENT DOCUMENTS

| | | | | |
|---|---|---|---|---|
| 11,365,527 | B2 * | 6/2022 | Kiyota | G06V 40/20 |
| 11,873,620 | B2 * | 1/2024 | Saiki | H04N 7/181 |
| 11,987,180 | B2 * | 5/2024 | Fukuoka | B60R 1/28 |
| 12,094,201 | B2 * | 9/2024 | Kashimoto | G06T 7/20 |
| 2013/0088593 | A1 * | 4/2013 | Ishimoto | E02F 9/226 348/143 |
| 2013/0182066 | A1 | 7/2013 | Ishimoto | |
| 2013/0222573 | A1 | 8/2013 | Onuma et al. | |
| 2018/0340316 | A1 | 11/2018 | Izumikawa | |
| 2019/0196466 | A1 * | 6/2019 | Agarwal | G05D 1/0061 |
| 2020/0258253 | A1 * | 8/2020 | Maeda | G06T 7/74 |
| 2021/0010243 | A1 | 1/2021 | Fukuoka | |
| 2022/0018096 | A1 | 1/2022 | Nishi | |
| 2022/0154425 | A1 | 5/2022 | Yamamoto et al. | |
| 2022/0154431 | A1 | 5/2022 | Kurosawa | |
| 2023/0394756 | A1 * | 12/2023 | Chen | G06T 19/20 |

FOREIGN PATENT DOCUMENTS

| | | |
|---|---|---|
| JP | 2010-198519 | 9/2010 |
| JP | 5667638 | 2/2015 |
| JP | 2019-071592 | 5/2019 |
| JP | 2020-148074 | 9/2020 |
| JP | 2020-165273 | 10/2020 |
| WO | 2012/043522 | 4/2012 |
| WO | 2017/138552 | 8/2017 |
| WO | 2019/189399 | 10/2019 |
| WO | 2020/204007 | 10/2020 |
| WO | 2021/025123 | 2/2021 |

* cited by examiner

CONSTRUCTION MACHINE AND ASSISTING DEVICE FOR CONSTRUCTION MACHINE

CROSS-REFERENCE TO RELATED APPLICATIONS

The present application is a continuation of International Patent Application No. PCT/JP2022/013323, filed Mar. 22, 2022, which is based on and claims priority to Japanese Patent Application No. 2021-047745, filed Mar. 22, 2021. The entire contents of these applications are incorporated herein by reference.

TECHNICAL FIELD

The present disclosure relates to a construction machine and an assisting device for a construction machine that provides assistance on work using the construction machine.

BACKGROUND

A shovel equipped with a display device that displays a three-dimensional computer graphics (CG) image of the shovel on three-dimensional design data is known.

SUMMARY OF THE INVENTION

An assisting device for a construction machine according to an embodiment of the present disclosure is an assisting device for a construction machine that provides assistance on work performed using a shovel, and includes a processor, the processor being configured to acquire feature data that is data concerning a position of a predetermined feature existing in a construction site based on an output from a space recognition device; and associate, based on the feature data, position information related to the construction site with data concerning the position of the feature to generate combined data, the position information related to the construction site being determined in a coordinate reference system that is different from a coordinate system with respect to a shovel.

DETAILED DESCRIPTION

The operator of the shovel cannot determine presence or absence of a predetermined feature around the shovel simply by looking at a screen image displaying a CG image of the shovel on the design data. In addition, even if the operator knows the location of the feature in advance, the location of the feature may be changed for certain reasons with respect to the construction site, for example.

Therefore, it is desirable to be able to more accurately know the situation of the feature at the construction site.

Figure 1:
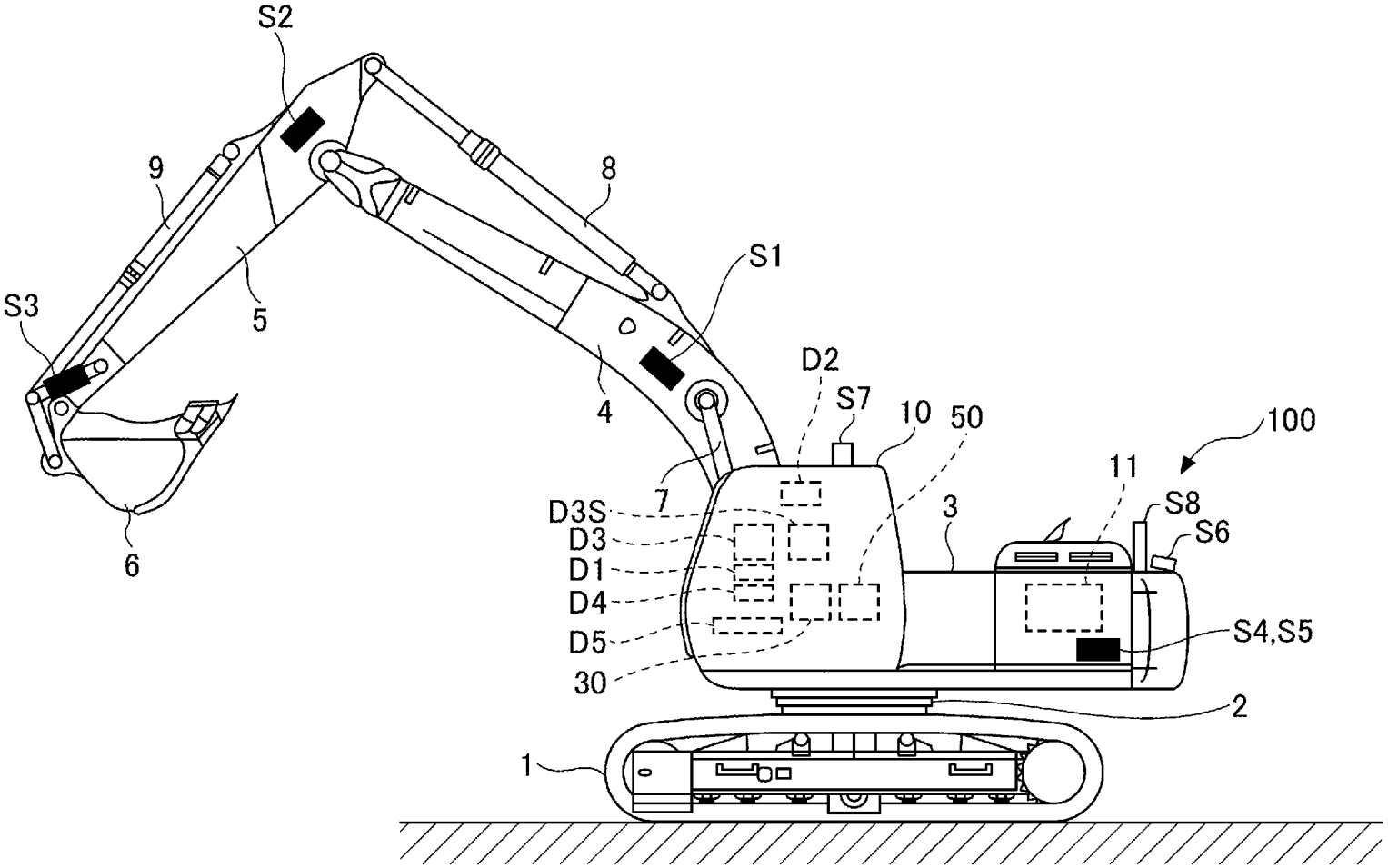
FIG. 1 is a side view of a shovel according to an embodiment of the present disclosure.

FIG. 1 is a side view of a shovel 100 as an excavator according to an embodiment of the present disclosure. An upper swinging body 3 is rotatably mounted on a lower traveling body 1 of the shovel 100 via a swinging mechanism 2. A boom 4 is mounted on the upper swinging body 3. An arm 5 is mounted on the tip of the boom 4, and a bucket 6 as an end attachment is mounted on the tip of the arm 5. The end attachment may be a bucket for a slope or a bucket for dredging.

The boom 4, the arm 5, and the bucket 6 form an excavation attachment, which is an example of an attachment, and are oil hydraulically driven by a boom cylinder 7, an arm cylinder 8, and a bucket cylinder 9, respectively. A boom angle sensor S1 is attached to the boom 4, an arm angle sensor S2 is attached to the arm 5, and a bucket angle sensor S3 is attached to the bucket 6. The excavation attachment may be provided with a bucket tilt mechanism.

The boom angle sensor S1 detects the rotation angle of the boom 4. In the present embodiment, the boom angle sensor S1 is an acceleration sensor and can detect the boom angle which is the rotation angle of the boom 4 with respect to the upper swinging body 3. The boom angle becomes the minimum angle when the boom 4 is lowered the furthest, for example, and increases as the boom 4 is lifted.

The arm angle sensor S2 detects the rotation angle of the arm 5. In the present embodiment, the arm angle sensor S2 is an acceleration sensor and can detect the arm angle, which is the rotation angle of the arm 5 with respect to the boom 4. For example, the arm angle becomes the minimum angle when the arm 5 is most closed, and increases as the arm 5 is opened.

The bucket angle sensor S3 detects the rotation angle of the bucket 6. In the present embodiment, the bucket angle sensor S3 is an acceleration sensor and can detect the bucket angle which is the rotation angle of the bucket 6 with respect to the arm 5. The bucket angle becomes the minimum angle when the bucket 6 is most closed, for example, and increases as the bucket 6 is opened.

The boom angle sensor S1, the arm angle sensor S2, and the bucket angle sensor S3 may be potentiometers each using a variable resistor, a stroke sensor for detecting the stroke amount of the corresponding oil hydraulic cylinder, or rotary encoders each for detecting the rotation angle around the connecting pin. The boom angle sensor S1, the arm angle sensor S2, and the bucket angle sensor S3 form an attitude sensor for detecting the attitude of the excavation attachment.

The upper swinging body 3 is provided with a cabin 10 serving as an operator's cab, and a power source such as an engine 11 is mounted in the upper swinging body 3. A machine body tilt sensor S4, a swinging angular velocity sensor S5, and a space recognition device S6 are provided in the upper swinging body 3. Also a communication device S7 and a positioning device S8 may be provided there.

The machine body tilt sensor S4 is configured to detect the tilt of the upper swinging body 3 with respect to a predetermined plane. In the present embodiment, the machine body tilt sensor S4 is an acceleration sensor for detecting the tilt angle of the upper swinging body 3 with respect to a horizontal plane around the front and rear axis and the tilt angle around the left and right axis. For example, the front and rear axis and the left and right axis of the upper swinging body 3 are orthogonal to each other, and pass through the center point of the shovel, which is a point on the swinging axis of the shovel 100.

The swinging angular velocity sensor S5 is configured to detect the swinging angular velocity of the upper swinging body 3. In the present embodiment, the swinging angular velocity sensor S5 is a gyro sensor. The swinging angular velocity sensor S5 may be a resolver or a rotary encoder. The swinging angular velocity sensor S5 may detect the swinging velocity. The swinging velocity may be calculated from the swinging angular velocity.

The space recognition device S6 is configured to recognize the state of the space around the shovel 100. The space recognition device S6 may be at least one of a rear space recognition device attached to the rear end of the upper surface of the upper swinging body 3, a left space recognition device attached to the left end of the upper surface of the upper swinging body 3, a right space recognition device attached to the right end of the upper surface of the upper swinging body 3, or a front space recognition device attached to the front end of the upper surface of the cabin 10. In the example shown in FIG. 1, the space recognition device S6 is a camera. However, the space recognition device S6 may be a LIDAR, ultrasonic sensor, millimeter-wave radar, infrared sensor, stereo camera, etc. In the example shown in FIG. 1, the space recognition device S6 includes the rear space recognition device, the front space recognition device, the left space recognition device, and the right space recognition device, but in FIG. 1, only the rear space recognition device is shown for clarity, and the front space recognition device, the left space recognition device, and the right space recognition device are omitted from FIG. 1.

The space recognition device S6 may be configured to detect a predetermined object in a predetermined area that is set around the shovel 100. For example, the space recognition device S6 may have a person detection function configured to detect a person while distinguishing between a person and an object other than a person.

The communication device S7 controls communication between the shovel 100 and the outside. For example, the communication device S7 controls radio communication between the external GNSS (Global Navigation Satellite System) survey system and the shovel 100. The shovel 100 can acquire design data via radio communication by using the communication device S7. However, the shovel 100 may acquire the design data by using a semiconductor memory or the like. The design data includes three-dimensional design data.

The positioning device S8 is configured to acquire information about the position of the shovel 100. In the present embodiment, the positioning device S8 is configured to measure the position and orientation of the shovel 100. Specifically, the positioning device S8 is a GNSS receiver incorporating an electronic compass and measures the latitude, longitude, and altitude of the current position of the shovel 100 and the orientation of the shovel 100.

An input device D1, a sound output device D2, a first display device D3, a second display device D3S, a storage device D4, a gate lock lever D5, a controller 30, and a shovel assisting device 50 are installed in the cabin 10.

The controller 30 functions as a main control part for controlling the operation of the shovel 100. In the present embodiment, the controller 30 includes an arithmetic and logic unit including a CPU and an internal memory. Various functions of the controller 30 are realized by the CPU executing programs stored in the internal memory.

The shovel assisting device 50 is an example of an assisting device for a construction machine and is configured to provide assistance on work performed by the shovel 100. In the present embodiment, for example, the shovel assisting device 50 is configured to visually and audibly inform the operator of the distance in the vertical direction between the target construction surface and the work portion of the bucket 6. The target construction surface is a part of the construction data derived from the design data. Thus, the shovel assisting device 50 can guide the operation of the shovel 100 performed by the operator. The shovel assisting device 50 may only visually inform the operator of the distance, or may only audibly inform the operator of the distance.

Specifically, the shovel assisting device 50, like the controller 30, includes an arithmetic and logic unit including a CPU and an internal memory. Various functions of the shovel assisting device 50 are realized by the CPU executing programs stored in the internal memory. The shovel assisting device 50 may be integrated in the controller 30.

The input device D1 is a device for the operator of the shovel 100 to input various information to the shovel assisting device 50. In the present embodiment, the input device D1 is a membrane switch mounted near the first display device D3. The input device D1 may be installed in association with each of the first display device D3 and the second display device D3S separately. In this case, the input devices D1 may be touch panels.

The sound output device D2 outputs various kinds of audio information in response to a sound output command from the shovel assisting device 50. In the present embodiment, the sound output device D2 is an on-board speaker directly connected to the shovel assisting device 50. The sound output device D2 may be an alarm such as a buzzer.

The first display device D3 and the second display device D3S output various kinds of image information in response to a command from the shovel assisting device 50. In the present embodiment, the first display device D3 and the second display device D3S are on-board liquid crystal displays directly connected to the shovel assisting device 50. The first display device D3 displays a camera image captured by the camera as the space recognition device S6. The camera image may be displayed on the second display device D3S. In the present embodiment, the screen size of the second display device D3S is larger than the screen size of the first display device D3. However, the screen size of the second display device D3S may be smaller than or equal to the screen size of the first display device D3.

The storage device D4 is a device for storing various kinds of information. In the present embodiment, a nonvolatile storage medium such as a semiconductor memory is used as the storage device D4. The storage device D4 stores the design data, etc. The storage device D4 may store various kinds of information output by the shovel assisting device 50, etc.

The gate lock lever D5 is a mechanism for preventing the shovel 100 from being operated erroneously. In the present embodiment, the gate lock lever D5 is disposed between the door of the cabin 10 and the operator's seat 10S. When the gate lock lever D5 is pulled up, the various operating devices become operable. On the other hand, when the gate lock lever D5 is pushed down, the various operating devices become inoperable.

Figure 2:
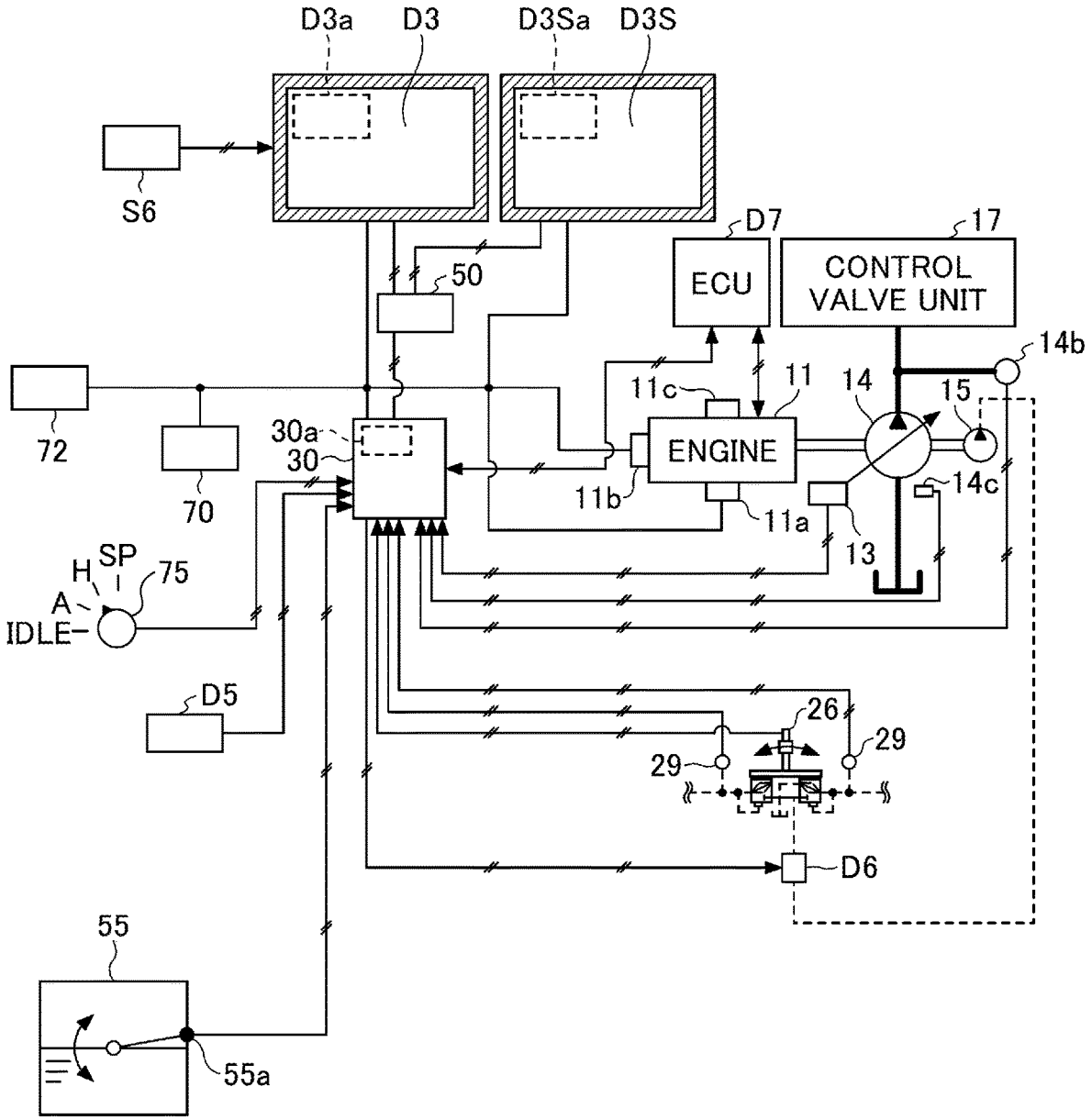
FIG. 2 is a diagram showing a configuration of a drive control system of the shovel of FIG. 1.

FIG. 2 is a diagram showing a configuration example of the drive control system of the shovel 100 shown in FIG. 1. In FIG. 2, the mechanical power transmission lines are indicated by double lines, the hydraulic oil lines are indicated by thick solid lines, the pilot lines are indicated by dashed lines, and the electric drive and control lines are indicated by thin solid lines.

The engine 11 powers the shovel 100. In the present embodiment, the engine 11 is a diesel engine employing isochronous control to maintain a constant engine speed regardless of an increase or decrease in the engine load. The amount of fuel injection, fuel injection timing, boost pressure, etc. in the engine 11 are controlled by an engine controller unit (ECU) D7.

The rotary shafts of a main pump 14 and a pilot pump 15 as oil hydraulic pumps are connected to the rotary shaft of the engine 11. A control valve unit 17 is connected to the main pump 14 through the hydraulic oil line.

The control valve unit 17 is an oil hydraulic control device for controlling the oil hydraulic system of the shovel 100. Oil hydraulic actuators such as left and right traveling oil hydraulic motors, a boom cylinder 7, an arm cylinder 8, a bucket cylinder 9, and a swinging oil hydraulic motor are connected to the control valve unit 17 through the hydraulic oil lines. The swinging oil hydraulic motor may be replaced with a swinging electric motor-generator.

A manual operation device 26 is connected to the pilot pump 15 via the pilot line. The manual operation device 26 includes a lever and a pedal. The manual operation device 26 is connected to the control valve unit 17 via the oil hydraulic line and the gate lock valves D6.

The gate lock valves D6 switch communicating/interrupting of the oil hydraulic lines connecting the control valve unit 17 and the manual operation device 26. In the present embodiment, the gate lock valves D6 are solenoid valves that switches communicating/interrupting of the oil hydraulic lines in response to a command from the controller 30. The controller 30 determines the state of the gate lock lever D5 based on the state signal output from the gate lock lever D5. When the controller 30 determines that the gate lock lever D5 is in the pulled-up state, it outputs a communicating command to the gate lock valves D6. When receiving the communicating command, the gate lock valves D6 open to enable the oil hydraulic lines to pass the hydraulic oil therethrough. As a result, the operator's operation on the manual operation device 26 becomes effective. On the other hand, when the controller 30 determines that the gate lock lever D5 is in the pushed-down state, it outputs an interrupting command to the gate lock valves D6. When receiving the interrupting command, the gate lock valves D6 close to prevent the oil hydraulic lines from passing the hydraulic oil therethrough. As a result, the operator's operation on the manual operation device 26 becomes invalid.

An operation sensor 29 detects the operation contents of the manual operation device 26. In the illustrated example, the operation sensor 29 is a pressure sensor and outputs a detection value to the controller 30. The operation sensor 29 may be another sensor such as an angle sensor or a resistance sensor.

FIG. 2 shows a connection relationship between the controller 30 and the first display device D3 and the second display device D3S. In the present embodiment, the first display device D3 and the second display device D3S are connected to the controller 30 via the shovel assisting device 50. The first display device D3, the second display device D3S, the shovel assisting device 50, and the controller 30 may be connected via a communication network such as a CAN.

The first display device D3 includes a conversion processing part D3*a* for generating an image. In the present embodiment, the conversion processing part D3*a* generates a camera image for being displayed based on the output of the camera as the space recognition device S6. The space recognition device S6 is connected to the first display device D3 via a dedicated line, for example.

The conversion processing part D3*a* generates an image for being displayed based on the output of the controller 30 or the shovel assisting device 50. In the present embodiment, the conversion processing part D3*a* converts various information output by the controller 30 or the shovel assisting device 50 into an image signal. The information output by the controller 30 includes, for example, data indicating the temperature of engine cooling water, data indicating the temperature of hydraulic oil, data indicating the remaining amount of fuel, data indicating the remaining amount of urea water, and the like. The information output by the shovel assisting device 50 includes data indicating the position of the work portion of the bucket 6, data indicating the orientation of the slope of the work target, data indicating the orientation of the shovel 100, data indicating the direction of operation needed for making the shovel 100 directly face the slope, and the like.

Like the first display device D3, the second display device D3S includes a conversion processing part D3Sa for generating an image. In the present embodiment, the second display device D3S is not directly connected to the space recognition device S6. Therefore, the conversion processing part D3Sa does not generate a camera image. However, the conversion processing part D3Sa may generate a camera image when the second display device D3S is directly connected to the space recognition device S6.

The conversion processing part D3Sa generates an image for being displayed based on the output of the shovel assisting device 50. In the present embodiment, the conversion processing part D3Sa converts various information output by the shovel assisting device 50 into an image signal. However, an image for being displayed may be generated based on the output of the controller 30.

The conversion processing part D3*a* may be realized not as a function that the first display device D3 has but as a function that the controller 30 or the shovel assisting device 50 has. The same applies to the conversion processing part D3Sa. In this case, the space recognition device S6 is not connected to the first display device D3 but to the controller 30 or the shovel assisting device 50.

The first display device D3 and the second display device D3S operate by receiving power from a storage battery 70.

The storage battery 70 is charged with power generated by an alternator 11*a* (generator) of the engine 11. The power of the storage battery 70 is supplied not only to the controller 30, the first display device D3, and the second display device D3S, but also to electrical equipment 72 of the shovel 100, and so forth. A starter 11*b* of the engine 11 is driven by the power from the storage battery 70 to start the engine 11.

The engine 11 is controlled by the engine controller unit D7. Various data indicating the state of the engine 11 is constantly transmitted from the engine controller unit D7 to the controller 30. The various data indicating the state of the engine 11 is an example of operation information of the shovel 100 and include, for example, data indicating the cooling water temperature detected by the water temperature sensor 11*c* as an operation information acquiring part. The controller 30 stores the data in a temporary storage part (memory) 30*a* and can transmit it to the first display device D3 when necessary.

Various data is supplied to the controller 30 as operation information of the shovel 100 as follows and is stored in the temporary storage part 30*a* of the controller 30.

For example, data indicating the swash plate tilt angle is supplied to the controller 30 from a regulator 13 of the main pump 14 which is a variable displacement oil hydraulic pump. Data indicating the discharge pressure of the main pump 14 is supplied to the controller 30 from a discharge pressure sensor 14*b*. These sorts of data are stored in the temporary storage part 30*a*. In addition, an oil temperature sensor 14*c* is provided in the pipe line between the main pump 14 and a tank where the hydraulic oil suctioned by the main pump 14 is stored, and data indicating the temperature of the hydraulic oil flowing in the pipe line is supplied from the oil temperature sensor 14*c* to the controller 30. The regulator 13, the discharge pressure sensor 14*b*, and the oil temperature sensor 14*c* are examples of operation information acquiring parts.

Data indicating the fuel storage amount is supplied to the controller 30 from a fuel storage amount detecting part 55*a* in the fuel storage part 55. In the present embodiment, data indicating the fuel storage amount state is supplied to the controller 30 from a fuel remaining amount sensor as the fuel storage amount detecting part 55*a* in the fuel tank as the fuel storage part 55.

Specifically, the fuel remaining amount sensor includes a float that follows the liquid surface and a variable resistor (potentiometer) that converts the vertically moving amount of the float into a resistance value. With this configuration, the fuel remaining amount sensor can continuously display the fuel remaining amount state in the first display device D3. The detection method of the fuel storage amount detection part can be appropriately selected according to the use environment, etc., and a detection method capable of displaying the fuel remaining amount state in stages may be adopted instead. These configurations are the same for the urea water tank.

When the manual operation device 26 is operated, the pilot pressure acting on the control valve unit 17 is detected by the operation sensor 29, and data indicating the detected pilot pressure is supplied to the controller 30.

In the present embodiment, the shovel 100 includes an engine speed adjustment dial 75 in the cabin 10. The engine speed adjustment dial 75 is a dial for the operator to adjust the speed of the engine 11 so that the engine speed can be switched in 4 stages. The engine speed adjustment dial 75 transmits data indicating the setting state of the engine speed to the controller 30. The engine speed adjustment dial 75 enables switching of the engine speed in 4 stages of a SP mode, a H mode, an A mode, and an IDLE mode. FIG. 2 shows a state in which the H mode is selected by the engine speed adjustment dial 75.

The SP mode is a speed mode selected when the amount of work is to be prioritized, and employs the highest engine speed. The H mode is a speed mode selected when the amount of work is to be balanced with the fuel consumption, and employs the second highest engine speed. The A mode is a speed mode selected when the shovel 100 is to be operated with low noise while giving priority to the fuel consumption, and employs the third highest engine speed. The IDLE mode is a speed mode selected when the engine 11 is to be idled, and employs the lowest engine speed. The engine 11 is controlled at the constant engine speed in accordance with the speed mode set by the engine speed adjustment dial 75.

Figure 3:
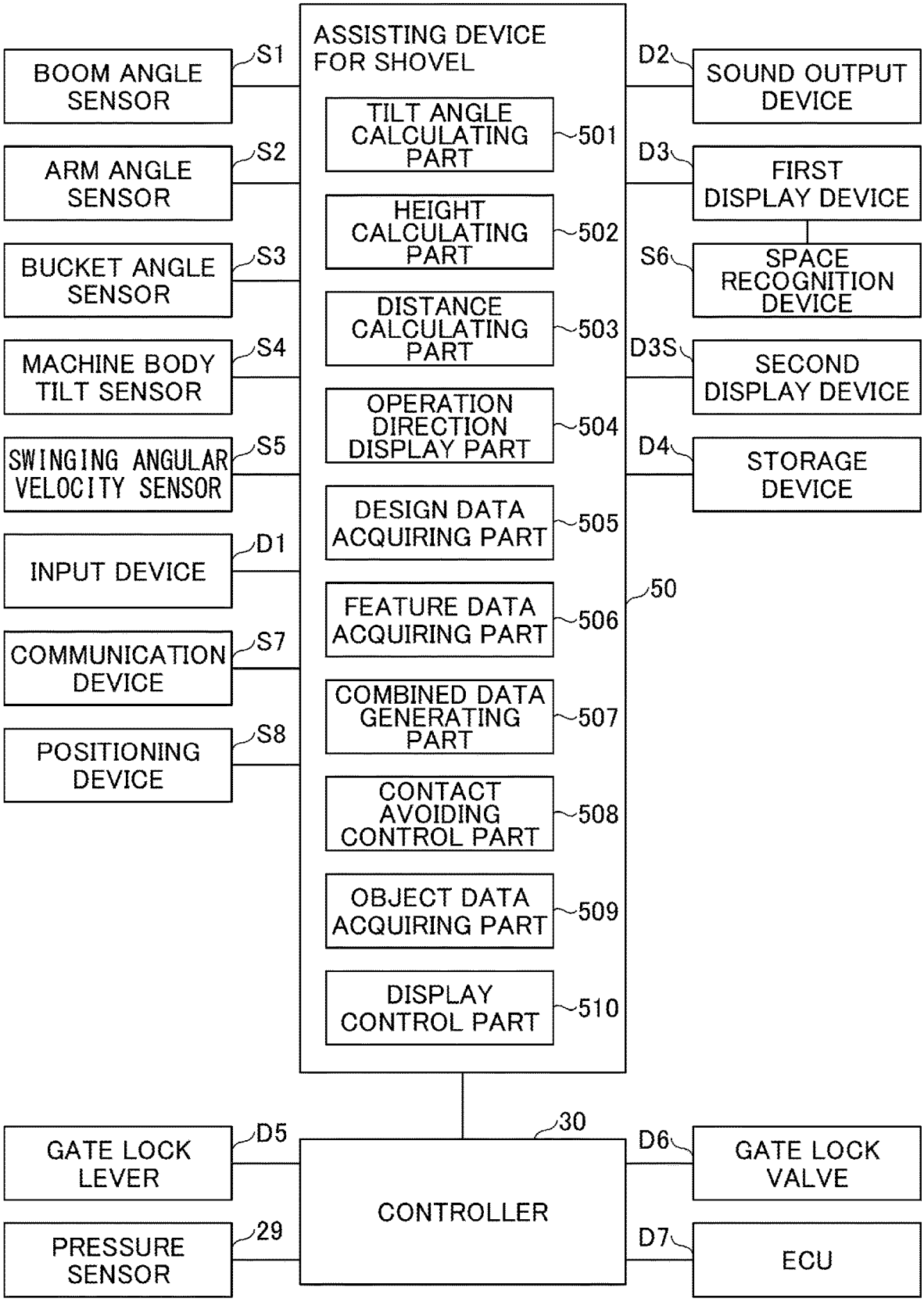
FIG. 3 is a block diagram showing an example of a configuration of an assisting device for a shovel.

Next, various functional elements of the shovel assisting device 50 will be described with reference to FIG. 3. FIG. 3 is a functional block diagram showing a configuration example of the shovel assisting device 50.

The shovel assisting device 50 receives information output from the boom angle sensor S1, the arm angle sensor S2, the bucket angle sensor S3, the machine body tilt sensor S4, the swinging angular velocity sensor S5, the input device D1, the communication device S7, the positioning device S8, the controller 30, and the like. Various arithmetic and logic operations are performed by the shovel assisting device 50 based on the received information and the information stored in the storage device D4, and the arithmetic and logic operation results are output to the sound output device D2, the first display device D3, the second display device D3S, and the like.

The shovel assisting device 50 calculates, for example, the height of the work portion of the attachment, and outputs a control command corresponding to the distance between the height of the work portion and a predetermined target height to at least one of the sound output device D2 or the first display device D3. The sound output device D2 receiving the control command outputs a sound indicating the magnitude of the distance. The first display device D3 receiving the control command displays an image representing the magnitude of the distance. The target height is a concept that may be the target depth. For example, in three-dimensional machine guidance (machine guidance using GNSS data), the target height is a height automatically calculated from the three-dimensional design data stored in the storage device D4 and the current position and orientation of the shovel 100. In two-dimensional machine guidance (machine guidance not using GNSS data), the target height is, for example, a height input by an operator as a vertical distance of the work portion with respect to a reference position after the work portion is brought into contact with the reference position having a known latitude, longitude, and altitude. In the following, information concerning the magnitude of the distance between the height of the work portion of the attachment and the target height displayed on the first display device D3 will be referred to as "guidance data". By viewing the guidance data, the operator can proceed with the work while confirming the transition of the magnitude of the distance.

The shovel assisting device 50 includes functional elements such as a tilt angle calculating part 501, a height calculating part 502, a distance calculating part 503, and an operation direction display part 504 for performing the guidance described above. In addition, the shovel assisting device 50 includes functional elements such as a design data acquiring part 505, a feature data acquiring part 506, a combined data generating part 507, a contact avoiding control part 508, an object data acquiring part 509, and a display control part 510 for more effectively using three-dimensional design data. These functional elements may be implemented by software, hardware, or a combination of software and hardware. The same applies to the other functional elements described below.

The tilt angle calculating part 501 calculates the tilt angle of the shovel 100 which is the tilt angle of the upper swinging body 3 with respect to a horizontal plane based on a detection signal from the machine body tilt sensor S4. That is, the tilt angle calculating part 501 calculates the tilt angle of the shovel 100 using the detection signal from the machine body tilt sensor S4.

The height calculating part 502 calculates the height of the work portion of the attachment with respect to a reference plane based on the tilt angle calculated by the tilt angle calculating part 501 and the angles of the boom 4, the arm 5, and the bucket 6 calculated from detection signals of the boom angle sensor S1, the arm angle sensor S2, and the bucket angle sensor S3, respectively. In an operation such as excavating with the tip of the bucket 6, the tip (the claw tip) of the bucket 6 corresponds to the work portion of the attachment. In an operation such as leveling earth and sand with the back face of the bucket 6, the back face of the bucket 6 corresponds to the work portion of the attachment. When a breaker is used as an end attachment other than the bucket 6, the tip of the breaker corresponds to the work portion of the attachment. The reference plane is, for example, a horizontal plane on which the shovel 100 is located.

The distance calculating part 503 calculates the distance between the height of the work portion calculated by the height calculating part 502 and the target height. In the case of operation such as excavating with the tip of the bucket 6, the distance calculating part 503 calculates the distance between the height of the tip (the claw tip) of the bucket 6 calculated by the height calculating part 502 and the target height. In the case of operation such as leveling earth and sand with the back face of the bucket 6, the distance calculating part 503 calculates the distance between the height of the back face of the bucket 6 calculated by the height calculating part 502 and the target height.

The operation direction display part 504 is a functional element for displaying, on the output image, an image representing the operation direction needed for making the shovel 100 directly face the slope as the operation target. In the present embodiment, the operation direction display part 504 automatically derives the direction directly facing the slope from the design data and superimposes an arrow indicating the operation direction needed for making the shovel 100 directly face the slope on the terrain image. The terrain image may be, for example, a target terrain image which is a three-dimensional CG image of the target construction surface. The operation direction display part 504 may display an image representing the operation direction needed for making the shovel 100 directly face the slope in a part other than the part where the terrain image is displayed. The image representing the operation direction may be an image representing the swinging direction or an image representing the traveling direction.

The design data acquiring part 505 is configured to acquire the three-dimensional design data. In the present embodiment, the design data acquiring part 505 is configured to acquire the three-dimensional design data through the communication device S7. The design data acquiring part 505 is configured to store the acquired three-dimensional design data in the storage device D4.

The three-dimensional design data is expressed in the coordinate reference system, for example. The coordinate reference system is, for example, a world geodetic system. The world geodetic system is a three-dimensional orthogonal XYZ coordinate system with its origin at the center of gravity of the earth, the X-axis in the direction of the intersection of the Greenwich meridian and the equator, the Y-axis in the direction of 90 degrees of east longitude, and the Z-axis in the direction of the North Pole.

The feature data acquiring part 506 is configured to acquire feature data as data concerning the range (location) where a predetermined feature exists near the shovel 100. In the present embodiment, the feature data acquiring part 506 recognizes the presence of a predetermined feature by applying an image recognition process to a camera image captured by a camera as the space recognition device S6. The image recognition process is, for example, a pattern matching process, a process using machine learning (a learning model such as deep learning), a process using a pattern recognition model such as a support vector machine, or a process using SIFT features. On the basis of the output of the positioning device SB, the feature data acquiring part 506 identifies the range where the predetermined feature recognized from the image exists. The range where the predetermined feature exists is identified, for example, by the coordinates (latitude, longitude, and altitude) with respect to the virtual three-dimensional figure surrounding the range. The virtual three-dimensional figure is, for example, a sphere, a box, a cylinder, a prism, a cone, a square pyramid, or the like. The coordinates related to the virtual three-dimensional figure are, for example, the coordinates of a vertex or a center point of the virtual three-dimensional figure.

The predetermined feature is a feature that the operator of the shovel 100 should pay attention to when performing the work by the shovel 100, such as a completed part of construction where construction work has been completed, a handrail installed on the top of the slope TS subject to the slope shaping work, a makeshift stairs, a wall, an electric wire, a road cone, or a building installed on the slope subject to the slope shaping work. The completed part of construction is a slope part where the slope shaping work has been completed, a ground part where the horizontally withdrawing work has been completed, or an excavation part where the excavation work has been completed.

The feature to be paid attention to is information thereof previously registered in the feature data acquiring part 506. Based on the output data output from the space recognition device S6 and the information registered in advance as the information of the feature to be paid attention to, the feature data acquiring part 506 determines whether or not the feature to be paid attention to exists, and the type or the position of the feature or the time of existence thereof if it exists from the output data of the space recognition device S6, and stores the determined information. For example, when the information registered in advance is information of an electric wire and a road cone, the feature data acquiring part 506 uses the output data of the space recognition device S6 and the information registered in advance to determine whether or not an electric wire or a road cone exists at the construction site. When the feature data acquiring part 506 determines that a road cone exists at the construction site, it records the position of the road cone and the time of existence thereof.

Further, when the feature to be paid attention to as the information registered in advance is a part where construction is completed, the feature data acquiring part 506 stores the position and time of the part where the construction is completed based on the information concerning the work of the shovel 100 in the past. The information concerning the work includes information concerning the work content determined based on the output from the attitude sensor of the shovel and the position where the work is performed.

The camera image may be an image output by a space recognition device (e.g., a camera, etc.) installed outside the shovel 100. The space recognition device installed outside the shovel 100 may be, for example, a space recognition device (e.g., a camera or LIDAR, etc.) mounted on a flying machine such as a drone, a camera mounted on a steel tower, etc. in the construction site, or a camera mounted on another shovel operating in the same construction site.

The feature data may be updated at a predetermined timing. For example, the feature data acquiring part 506 may be configured to acquire feature data from a device external to the shovel 100 at every predetermined time interval. The device external to the shovel 100 is, for example, a shovel assisting device mounted on another shovel operating in the same construction site. In this case, the shovel 100 can share feature data between the shovel 100 and another shovel. Even if another shovel does not have a space recognition device, the operator of another shovel can understand the positional relationship between the feature and the target construction surface at the construction site. The feature data acquiring part 506 may be provided in a management device that is connected to the shovel 100 via a communication network.

The combined data generating part 507 is configured to generate combined data by combining the design data indicating location information related to the construction site and the feature data. In the present embodiment, the combined data generating part 507 is configured to generate combined data by combining the design data acquired by the design data acquiring part 505 and the feature data acquired by the feature data acquiring part 506. Specifically, the combined data generating part 507 integrates the feature data, which is information concerning the range (location) where a predetermined feature exists identified by the feature data acquiring part 506, as part of the design data. A case in which the three-dimensional design data is used as the design data will be described below.

In addition, the combined data generating part 507 may be configured to generate the combined data by combining the terrain data indicating location information related to the construction site and the feature data. The terrain data is acquired by recognizing the construction site with the space recognition device installed outside the shovel 100. For example, the terrain data of the construction site is acquired by the space recognition device (for example, a camera, LIDAR, etc.) mounted on a flying machine such as a drone.

Thus, the combined data generating part 507 associates the positional information (the design data or terrain data) related to the construction site with data concerning the position of the feature included in the feature data, and stores the information and the data.

The contact avoiding control part 508 is configured to perform control to avoid contact between the predetermined feature and the shovel 100 based on the combined data. In the present embodiment, the contact avoiding control part 508 calculates the distance between the shovel 100 and the predetermined feature, using information concerning the position and orientation of the shovel 100 output by the positioning device S8 and the combined data which is three-dimensional design data in which the feature data is integrated. The contact avoiding control part 508 outputs a contact avoidance command to the controller 30 when having determined that the distance has fallen below a predetermined distance. The controller 30 receiving the contact avoidance command suppresses or stops the movement of the shovel 100. For example, the controller 30 stops the movements of the oil hydraulic actuators by outputting the interrupting command to the gate lock valves D6.

The object data acquiring part 509 is configured to acquire object data which is data on the position of an object around the shovel 100. In the present embodiment, the object data acquiring part 509 acquires data concerning the position of an object (e.g., a person), which is not identified as a predetermined feature, as the object data, when the distance between the object and the shovel 100 is less than or equal to the predetermined distance. The object data may be limited, for example, to data on an object having a height greater than or equal to a predetermined height. That is, the object data acquiring part 509 may be configured not to acquire data concerning the position of an object not identified as the predetermined feature as the object data when having determined that the height of the object is less than the predetermined height, even when the distance between the object and the shovel 100 becomes less than or equal to the predetermined distance.

The object data is expressed by coordinates (latitude, longitude, and altitude) in the coordinate reference system, for example. The object data acquiring part 509 calculates the distance between the object and the shovel 100 based on, for example, a camera image captured by the camera as the space recognition device S6. The object data acquiring part 509 may calculate the distance between the object and the shovel 100 based on, for example, distance data acquired by a LIDAR as the space recognition device S6.

The combined data generating part 507 may combine the object data with the three-dimensional design data or the terrain data. For example, the combined data generating part 507 may integrate the object data acquired by the object data acquiring part 509 as part of the three-dimensional design data or the terrain data.

The contact avoiding control part 508 may perform control to avoid contact between the object and the shovel 100 based on the three-dimensional design data in which the object data is integrated. The contact avoiding control part 508 may perform control to avoid contact between the object and the shovel 100 based on the terrain data in which the object data is integrated.

The display control part 510 is configured to display the combined data on the display device. In the present embodiment, the display control part 510 is configured to display the combined data on the second display device D3S.

Specifically, the display control part 510 displays a preregistered icon at the position of the predetermined feature in a virtual space represented by the three-dimensional design data or the terrain data. The position of the predetermined feature is, for example, the coordinates of the center of the range where the predetermined feature exists identified by the feature data acquiring part 506. The icon registered in advance is, for example, an illustration image representing the predetermined feature and may include text information.

Alternatively, the display control part 510 may display a model of the predetermined feature at the location of the predetermined feature in the virtual space represented by the design data or the terrain data. The model of the predetermined feature may be, for example, a three-dimensional model (such as a three-dimensional polygon model) generated based on a camera image captured by a camera as the space recognition device S6.

The display control part 510 may be configured to display a mark such as "X" or "O" at the position indicated by the object data. For example, the display control part 510 may be configured to display a mark at the position of the object data acquired by the object data acquiring part 509 in the virtual space represented by the three-dimensional design data or the terrain data.

Figure 4:
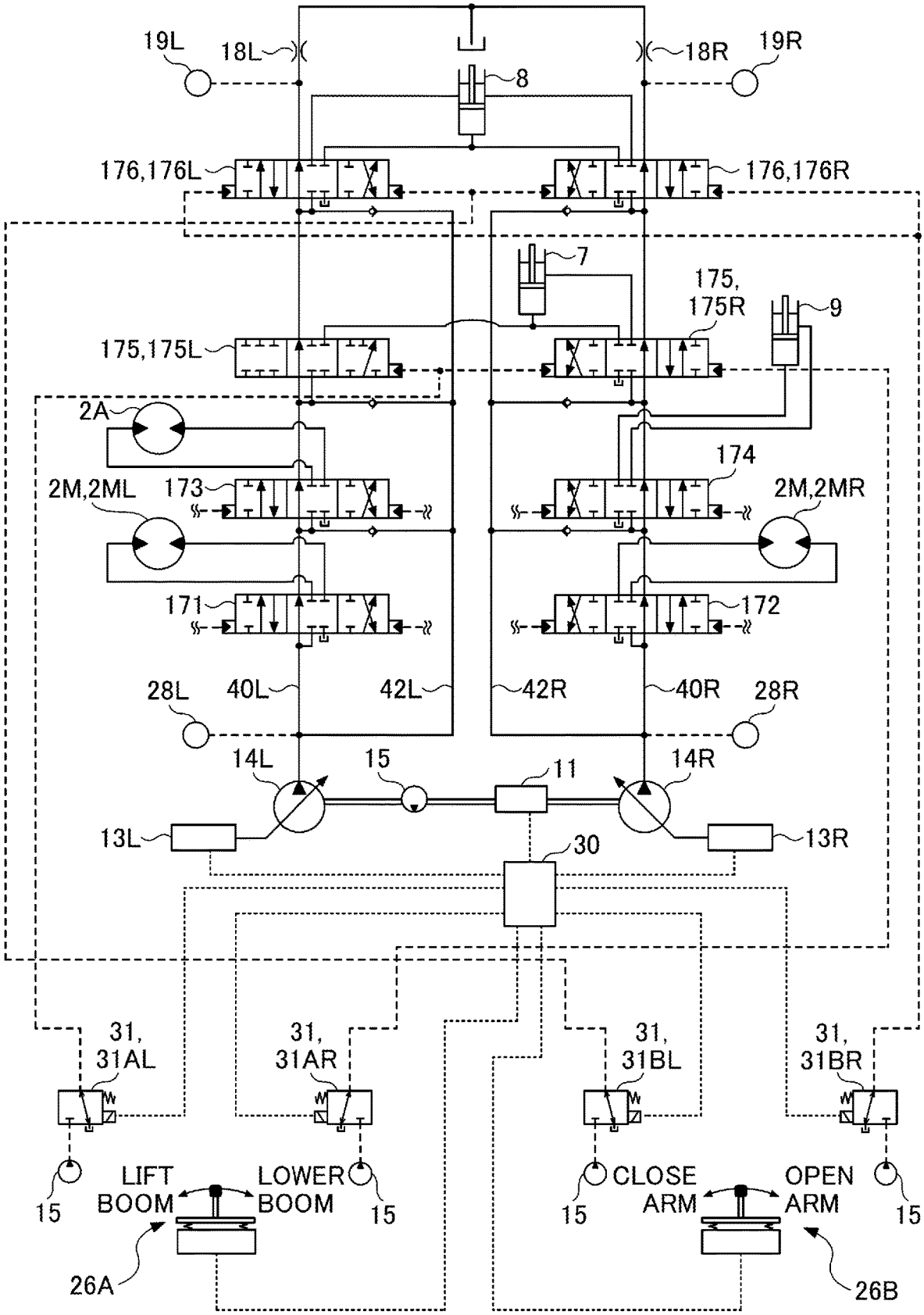
FIG. 4 shows an example of a configuration of an oil hydraulic system mounted on the shovel.

Referring now to FIG. 4, a configuration example of the oil hydraulic system mounted on the shovel 100 will be described. FIG. 4 shows a configuration example of the oil hydraulic system mounted on the shovel 100 of FIG. 1. FIG. 4 shows the mechanical power transmission lines, the hydraulic oil lines, the pilot lines, and the electrical control lines as double lines, solid lines, dashed lines, and dotted lines, respectively.

The oil hydraulic system circulates the hydraulic oil from the left main pump 14L driven by the engine 11 to the hydraulic oil tank via the left center bypass pipe line 40L or the left parallel pipe line 42L, and circulates the hydraulic oil from the right main pump 14R driven by the engine 11 to the hydraulic oil tank via the right center bypass pipe line 40R or the right parallel pipe line 42R.

The left center bypass pipe line 40L is a hydraulic oil line passing through the control valves 171, 173, 175L and 176L located within the control valve unit 17. The right center bypass pipe line 40R is a hydraulic oil line passing through the control valves 172, 174, 175R and 176R located within the control valve unit 17.

The control valve 171 is a spool valve which switches the flow of the hydraulic oil to supply the hydraulic oil discharged by the left main pump 14L to the left traveling oil hydraulic motor 1L and discharge the hydraulic oil discharged by the left traveling oil hydraulic motor 1L to the hydraulic oil tank.

The control valve 172 is a spool valve which switches the flow of the hydraulic oil to supply the hydraulic oil discharged by the right main pump 14R to the right traveling oil hydraulic motor 1R and discharge the hydraulic oil discharged by the right traveling oil hydraulic motor 1R to the hydraulic oil tank.

The control valve 173 is a spool valve which switches the flow of the hydraulic oil to supply the hydraulic oil discharged by the left main pump 14L to the swinging oil hydraulic motor 2A and discharge the hydraulic oil discharged by the swinging oil hydraulic motor 2A to the hydraulic oil tank.

The control valve 174 is a spool valve which switches the flow of the hydraulic oil to supply the hydraulic oil discharged by the right main pump 14R to the bucket cylinder 9 and discharge the hydraulic oil in the bucket cylinder 9 to the hydraulic oil tank.

The control valve 175L is a spool valve which switches the flow of the hydraulic oil to supply the hydraulic oil discharged by the left main pump 14L to the boom cylinder 7.

The control valve 175R is a spool valve which switches the flow of the hydraulic oil to supply the hydraulic oil discharged by the right main pump 14R to the boom cylinder 7 and discharge the hydraulic oil in the boom cylinder 7 to the hydraulic oil tank.

The control valve 176L is a spool valve which switches the flow of the hydraulic oil to supply the hydraulic oil discharged by the left main pump 14L to the arm cylinder 8 and discharge the hydraulic oil in the arm cylinder 8 to the hydraulic oil tank.

The control valve 176R is a spool valve which switches the flow of the hydraulic oil to supply the hydraulic oil discharged by the right main pump 14R to the arm cylinder 8 and discharge the hydraulic oil in the arm cylinder 8 to the hydraulic oil tank.

The left parallel pipe line 42L is a hydraulic oil line parallel to the left center bypass pipe line 40L. The left parallel pipe line 42L can supply the hydraulic oil to the downstream control valve when the hydraulic oil flow through the left center bypass pipe line 40L is restricted or blocked by any of the control valves 171, 173, or 175L. The right parallel pipe line 42R is a hydraulic oil line parallel to the right center bypass pipe line 40R. The right parallel pipe line 42R can supply the hydraulic oil to the downstream control valve when the hydraulic oil flow through the right center bypass pipe line 40R is restricted or blocked by any of the control valves 172, 174, 175R.

The left regulator 13L is configured to control the discharge of the left main pump 14L. In the present embodiment, the left regulator 13L controls the discharge of the left main pump 14L by, for example, adjusting the swash plate tilt angle of the left main pump 14L in accordance with the discharge pressure of the left main pump 14L. The right regulator 13R is configured to control the discharge of the right main pump 14R. In the present embodiment, the right regulator 13R controls the discharge of the right main pump 14R by, for example, adjusting the swash plate tilt angle of the right main pump 14R in accordance with the discharge pressure of the right main pump 14R. The left regulator 13L reduces the discharge amount by, for example, adjusting the swash plate tilt angle of the left main pump 14L in accordance with an increase in the discharge pressure of the left main pump 14L. The same applies to the right regulator 13R. This is to prevent the pump absorption horsepower expressed by the product of the discharge pressure and the discharge amount from exceeding the output horsepower of the engine 11. The pump absorption horsepower is the sum of the absorption horsepower of the left main pump 14L and the absorption horsepower of the right main pump 14R.

The left discharge pressure sensor 28L is an example of the discharge pressure sensor 28, which detects the discharge pressure of the left main pump 14L and outputs the detected value to the controller 30. The same applies to the right discharge pressure sensor 28R.

The negative control employed in the oil hydraulic system of FIG. 4 will now be described.

In the left center bypass pipe line 40L, a left choke 18L is disposed between the control valve 176L located at the furthest downstream and the hydraulic oil tank. The flow of hydraulic oil discharged from the left main pump 14L is limited by the left choke 18L. The left choke 18L generates a control pressure for controlling the left regulator 13L. A left control pressure sensor 19L is a sensor for detecting the control pressure, and outputs the detected value to the controller 30. In the right center bypass pipe line 40R, the right choke 18R is disposed between the control valve 176R at the furthest downstream and the hydraulic oil tank. The flow of hydraulic oil discharged from the right main pump 14R is limited by the right choke 18R. The right choke 18R generates a control pressure for controlling the right regulator 13R. A right control pressure sensor 19R is a sensor for detecting the control pressure, and outputs the detected value to the controller 30.

The controller 30 controls the discharge amount of the left main pump 14L by adjusting the swash plate tilt angle of the left main pump 14L according to the control pressure. The controller decreases the discharge amount of the left main pump 14L as the control pressure is larger, and increases the discharge amount of the left main pump 14L as the control pressure is smaller. The discharge amount of the right main pump 14R is controlled in the same manner.

Specifically, as shown in FIG. 4, when the oil hydraulic actuators in the shovel 100 are in a standby state in which none of the oil hydraulic actuators are operated, the hydraulic oil discharged from the left main pump 14L passes through the left center bypass pipe line 40L to the left choke 18L. The flow of hydraulic oil discharged from the left main pump 14L increases the control pressure generated upstream of the left choke 18L. As a result, the controller 30 reduces the discharge amount of the left main pump 14L to the allowable minimum discharge amount and suppresses the pressure loss (pumping loss) occurring when the discharged hydraulic oil passes through the left center bypass pipe line 40L. On the other hand, when any hydraulic actuator is operated, the hydraulic oil discharged by the left main pump 14L flows into the hydraulic actuator that is operated via the control valve corresponding to the hydraulic actuator that is operated. The flow of the hydraulic oil discharged by the left main pump 14L reduces or eliminates the amount reaching the left choke 18L and reduces the control pressure generated upstream of the left choke 18L. As a result, the controller 30 increases the discharge amount of the left main pump 14L, circulates the sufficient hydraulic oil to the hydraulic actuator that is operated, and ensures the operation of the hydraulic actuator that is operated. The same applies to the hydraulic oil discharged by the right main pump 14R.

With the above-described configuration, the oil hydraulic system of FIG. 4 can suppress the wasteful energy consumption of the left main pump 14L and the right main pump 14R, respectively, in the standby state. The wasteful energy consumption includes the pumping loss caused by the hydraulic oil discharged by the left main pump 14L in the left center bypass pipe line 40L, and the pumping loss caused by the hydraulic oil discharged by the right main pump 14R in the right center bypass pipe line 40R. In addition, the oil hydraulic system shown in FIG. 4 can supply the necessary and sufficient hydraulic oil from each of the left main pump 14L and the right main pump 14R to the hydraulic actuator that is operated when the hydraulic actuator is operated.

Next, a configuration for automatically operating the actuator will be described. A boom operation lever 26A is an example of an electric operation lever as a manual operation device 26 and is used by the operator to operate the boom 4. The boom operation lever 26A detects the operation direction and the operation amount, and outputs the detected operation direction and the operation amount as operation data (electric signals) to the controller 30. When the boom operation lever 26A is operated by the operator in the boom lifting direction in case of manual control, the controller 30 controls the opening degree of a proportional valve 31AL in accordance with the operation amount of the boom operation lever 26A. Thus, the pilot pressure in accordance with the operation amount of the boom operation lever 26A is applied to the right pilot port of the control valve 175L and the left pilot port of the control valve 175R, with the use of the hydraulic oil discharged from the pilot pump 15. When the boom operation lever 26A is operated by the operator in the direction of lowering the boom in case of manual control, the controller 30 controls the opening degree of the proportional valve 31AR in accordance with the operation amount of the boom operation lever 26A. As a result, the pilot pressure corresponding to the operation amount of the boom operation lever 26A is applied to the right pilot port of the control valve 175R with the use the hydraulic oil discharged from the pilot pump 15.

The proportional valves 31AL and 31AR form a boom proportional valve 31A, which is an example of the proportional valve 31 as a solenoid valve. The proportional valve 31AL operates in accordance with the current command adjusted by the controller 30. The controller 30 adjusts the pilot pressure applied by the hydraulic oil introduced from the pilot pump 15 to the right pilot port of the control valve 175L and the left pilot port of the control valve 175R via the proportional valve 31AL. The proportional valve 31AR operates in accordance with the current command adjusted by the controller 30. The controller 30 adjusts the pilot pressure applied by the hydraulic oil introduced from the pilot pump 15 to the right pilot port of the control valve 175R via the proportional valve 31AR. The proportional valves 31AL, 31AR can adjust the pilot pressures so that the control valves 175L, 175R can be stopped at any valve positions.

With this configuration, the controller 30 can supply the hydraulic oil discharged by the pilot pump 15 to the right pilot port of the control valve 175L and the left pilot port of the control valve 175R through the proportional valve 31AL, independently of boom-lifting operation that is performed by the operator, in case of automatic excavation control. That is, the controller 30 can lift the boom 4 automatically. The controller 30 can also supply the hydraulic oil discharged by the pilot pump 15 to the right pilot port of the control valve 175R via the proportional valve 31AR, independently of boom lowering operation that is performed by the operator. That is, the controller 30 can automatically lower the boom 4.

The arm operation lever 26B is another example of the electric operation lever as the manual operation device 26 and is used by the operator to operate the arm 5. The arm operation lever 26B detects the operation direction and the operation amount, and outputs the detected operation direction and the operation amount as operation data (electric signals) to the controller 30. When the arm operation lever 26B is operated in the arm opening direction in case of manual control, the controller 30 controls the opening degree of the proportional valve 31BR according to the operation amount of the arm operation lever 26B. Thus, the pilot pressure according to the operation amount of the arm operation lever 26B is applied to the left pilot port of the control valve 176L and the right pilot port of the control valve 176R with the use of the hydraulic oil discharged from the pilot pump 15. When the arm operation lever 26B is operated in the arm closing direction in case of manual control, the controller 30 controls the opening degree of the proportional valve 31BL according to the operation amount of the arm operation lever 26B. As a result, the pilot pressure according to the operation amount of the arm operation lever 26B is applied to the right pilot port of the control valve 176L and the left pilot port of the control valve 176R with the use of the hydraulic oil discharged from the pilot pump 15.

The proportional valves 31BL and 31BR form an arm proportional valve 31B, which is an example of the proportional valve 31. The proportional valve 31BL operates in accordance with the current command adjusted by the controller 30. The controller 30 adjusts the pilot pressure applied by the hydraulic oil introduced from the pilot pump 15 to the right pilot port of the control valve 176L and the left pilot port of the control valve 176R via the proportional valve 31BL. The proportional valve 31BR operates in accordance with the current command adjusted by the controller 30. The controller 30 adjusts the pilot pressure applied by the hydraulic oil introduced from the pilot pump 15 to the left pilot port of the control valve 176L and the right pilot port of the control valve 176R via the proportional valve 31BR. The proportional valves 31BL and 31BR can adjust the pilot pressures so that the control valves 176L and 176R can be stopped at any valve positions.

With this configuration, the controller 30 can supply the hydraulic oil discharged by the pilot pump 15 to the right pilot port of the control valve 176L and the left pilot port of the control valve 176R through the proportional valve 31BL, independently of the operator's arm closing operation. That is, the controller 30 can automatically close the arm 5. The controller 30 can also supply the hydraulic oil discharged from the pilot pump 15 to the left pilot port of the control valve 176L and the right pilot port of the control valve 176R via the proportional valve 31BR, independently of the operator's arm opening operation. That is, the controller 30 can automatically open the arm 5.

Thus, in the automatic excavation control, the arm cylinder 8 and the boom cylinder 7 automatically operate in accordance with the operation amount of the arm operation lever 26B, and thus, the speed control or the position control of the working portions is executed.

The shovel 100 may be provided with a configuration for automatically swinging the upper swinging body 3 left or right, a configuration for automatically opening or closing the bucket 6, and a configuration for automatically moving the lower traveling body 1 forward or backward. In this case, the oil hydraulic system portion relating to the swinging oil hydraulic motor 2A, the oil hydraulic system portion relating to the operation of the bucket cylinder 9, the oil hydraulic system portion relating to the operation of the left traveling hydraulic motor 1L, and the oil hydraulic system portion relating to the operation of the right traveling hydraulic motor 1R may be configured in the same manner as the oil hydraulic system portion relating to the operation of the boom cylinder 7.

Figure 5:
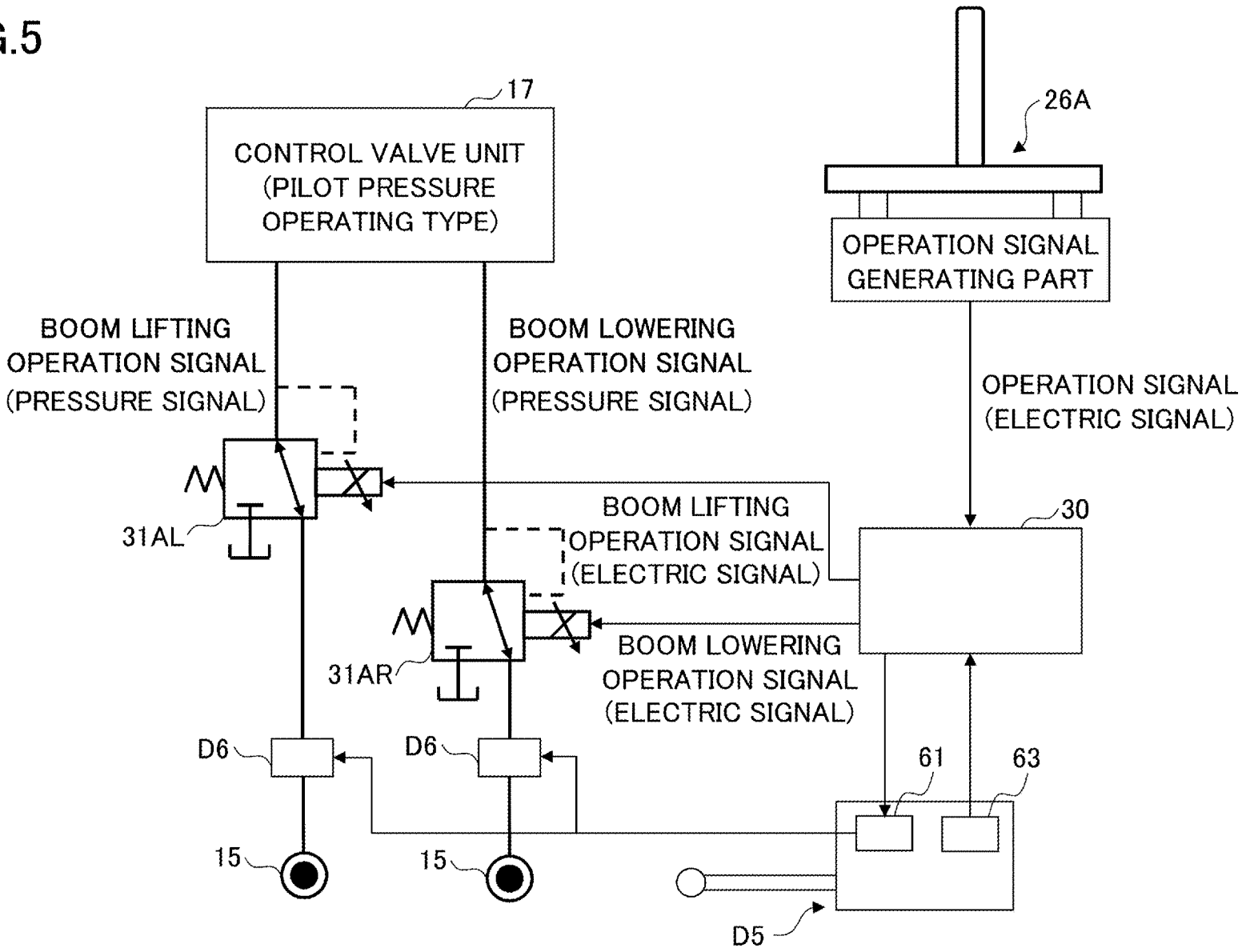
FIG. 5 schematically shows an example of a configuration of an electric operation system.

Next, the electric operation system of the shovel 100 according to the present embodiment will be described with reference to FIG. 5. FIG. 5 schematically shows a configuration example of the electric operation system of the shovel 100 according to the present embodiment. In FIG. 5, as an example of the electric operation system, a boom operation system for lifting and lowering the boom 4 will be described. The electric operation system may also be applied as a traveling operation system for moving forward and backward the lower traveling body 1, a swinging operation system for swinging the upper swinging body 3, an arm operation system for opening and closing the arm 5, and a bucket operation system for opening and closing the bucket 6.

The electric operation system shown in FIG. 5 includes the boom operation lever 26A as the electric operation lever, the pilot pump 15, the pilot pressure operating type control valve unit 17, the proportional valve 31AL for boom lifting operation, the proportional valve 31AR for boom lowering operation, the controller 30, the gate lock lever D5, and the gate lock valves D6.

The boom operation lever 26A (the operation signal generating part), which is an example of the manual operation device, is provided with a sensor such as an encoder or a potentiometer capable of detecting the operation amount (the tilt amount) and the tilt direction. The operation signal (the electric signal) corresponding to the operation of the boom operation lever 26A by the operator detected by the sensor of the boom operation lever 26A is input to the controller 30.

The proportional valve 31AL is provided in the pilot line for supplying the hydraulic oil from the pilot pump 15 to the boom lifting pilot port of the control valve unit 17 (see the control valves 175L and 175R shown in FIG. 4). The proportional valve 31AL is a solenoid valve capable of adjusting the opening degree thereof, and the opening degree of the proportional valve 31AL is controlled in accordance with the boom lifting operation signal (the electric signal) which is a control signal from the controller 30. By controlling the opening degree of the proportional valve 31AL, the pilot pressure as the boom lifting operation signal (the pressure signal) applied to the boom lifting pilot port is controlled. Similarly, the proportional valve 31AR is provided in the pilot line that supplies the hydraulic oil from the pilot pump 15 to the boom lowering pilot port of the control valve unit 17 (see the control valves 175L and 175R shown in FIG. 4). The proportional valve 31AR is a solenoid valve that can adjust the opening degree thereof, and the opening degree of the proportional valve 31AR is controlled in accordance with the boom lowering operation signal (the electrical signal) that is a control signal from the controller 30. The pilot pressure as the boom lowering operation signal (the pressure signal) applied to the boom lowering pilot port is controlled by controlling the opening degree of the proportional valve 31AR.

The controller 30 outputs the boom lifting operation signal (the electric signal) and the boom lowering operation signal (the electric signal) controlling the opening degrees of the proportional valves 31AL and 31AR. Thus, the controller 30 can control the operation of the boom 4 by controlling the flow rate and flow direction of the hydraulic oil supplied from the left main pump 14L and the right main pump 14R to the boom cylinder 7 via the proportional valves 31AL and 31AR and the control valve unit 17 (the control valves 175L, 175R).

For example, when manual operation of the shovel 100 is performed, the controller 30 generates and outputs the boom lifting operation signal (the electric signal) or the boom lowering operation signal (the electric signal) in response to the operation signal (electric signal) of the boom operation lever 26A. For example, when automatic control of the shovel 100 is performed, the controller 30 generates and outputs the boom lifting operation signal (the electric signal) or the boom lowering operation signal (the electric signal) based on a set program or the like.

The gate lock lever D5 is provided in the cabin 10 near the entrance thereof. The gate lock lever D5 is provided in a swingable manner. The operator pulls up the gate lock lever D5 to make it almost horizontal to cause the gate lock valves D6 to be in unlocked states, and pushes down the gate lock lever D5 to cause the gate lock valves D6 to be in locked states. With the gate lock lever D5 pulled up, the gate lock lever D5 blocks the entrance of the cabin 10 to prevent the operator from exiting the cabin 10. On the other hand, with the gate lock lever D5 pushed down, the gate lock lever D5 opens the entrance of the cabin 10 to allow the operator to exit the cabin 10.

A limit switch 61 is a switch that turns on (allows current flow therethrough) when the gate lock lever D5 is pulled up and turns off (does not allow current flowing therethrough) when the gate lock lever D5 is pushed down.

The gate lock valves D6 are opening/closing valves provided in the pilot lines between the pilot pumps 15 and the proportional valves 31 (31AL, 31AR). The gate lock valves D6 are, for example, solenoid valves that open when being energized and close when not being energized. The limit switch 61 is disposed in the power supply circuit of the gate lock valves D6. Thus, when the limit switch 61 turns on, the gate lock valves D6 are opened. When the limit switch 61 turns off, the gate lock valves D6 are closed. That is, when the limit switch 61 turns on, the gate lock valves D6 are opened and are in unlocked states to enable operation of the boom 4 by the operator via the boom operation lever 26A. On the other hand, when the limit switch 61 turns off, the gate lock valves D6 are closed and are in locked states to prevent operation of the boom 4 by the operator via the boom operation lever 26A.

A locked state detection sensor 63 detects whether the gate lock valves D6 are in unlocked states of locked states. For example, the locked state detection sensor 63 is a voltage sensor (or, a current sensor) provided in an electrical circuit connecting the gate lock valves D6 and the limit switch 61, and detects the unlocked states/lock states of the gate lock valves D6 by detecting the turning on/off of the limit switch 61. The detection result is output to the controller 30. The locked state detection sensor 63 may be configured to detect the unlocked states/lock states of the gate lock valves D6 by directly detecting the position of the lever.

The controller 30 may be configured in such a manner that even when the gate lock lever D5 is pulled up, the limit switch 61 can be made to turn off to close the gate lock valves D6 and make the boom 4 inoperable.

FIG. 5 shows a configuration for switching between an operable state and an inoperable state of the boom 4 (the boom cylinder 7) by the gate lock lever D5. In this regard, the gate lock lever D5 is configured to also simultaneously switch between operable states and inoperable states of the arm 5 (the arm cylinder 8), the bucket 6 (the bucket cylinder 9), swinging (the swinging oil hydraulic motor 2A), traveling (the traveling oil hydraulic motor 2M), and so forth, respectively. However, the gate lock lever D5 may be configured to individually switch between operable states and inoperable states of the arm 5 (the arm cylinder 8), the bucket 6 (the bucket cylinder 9), swinging (the swinging oil hydraulic motor 2A), traveling (the traveling oil hydraulic motor 2M), respectively.

Figure 6:
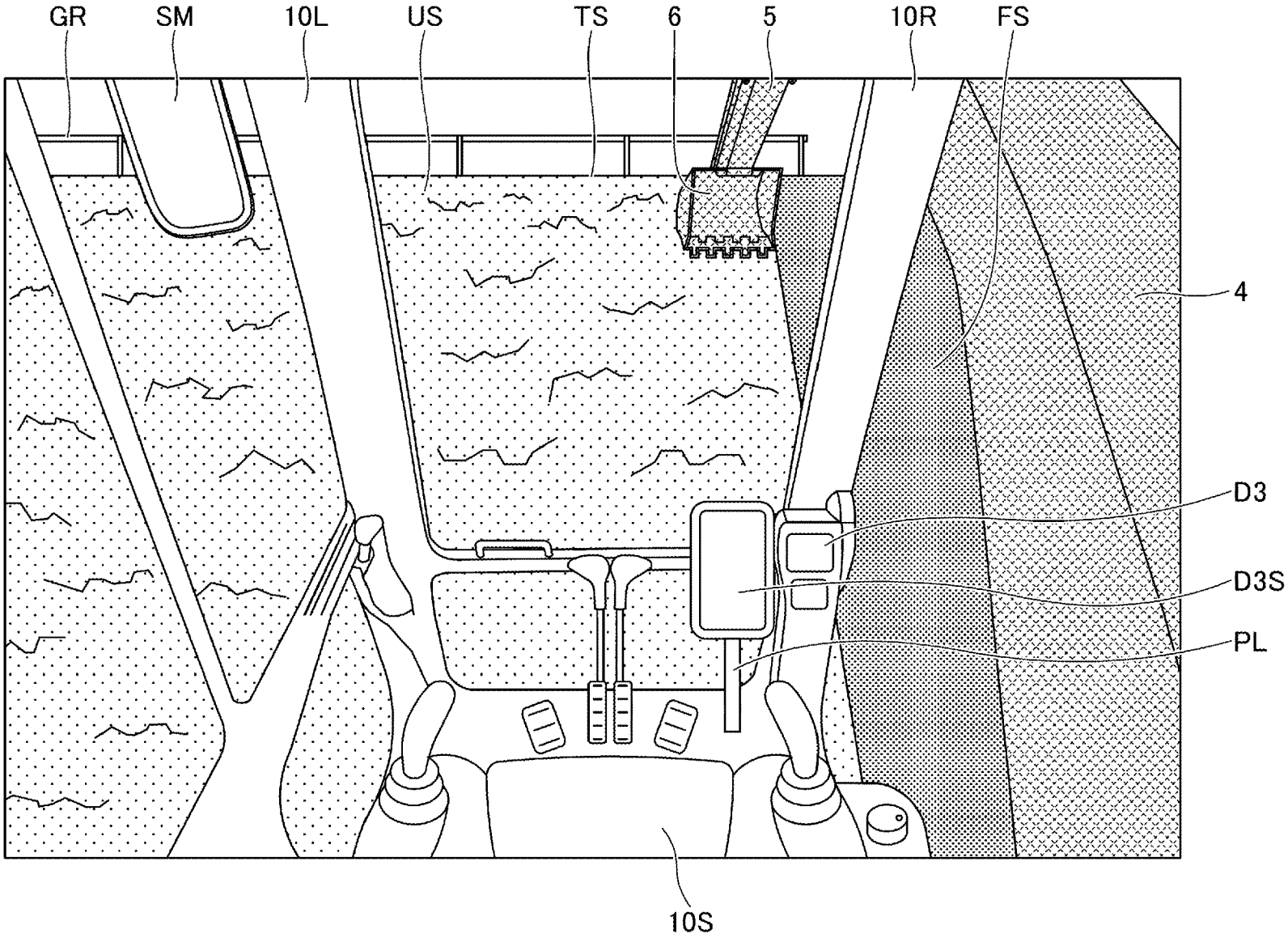
FIG. 6 shows an example of a scene seen by an operator seated in an operator's seat installed in the shovel's cabin when performing a slope shaping operation.

Next, with reference to FIGS. 6 to 8, details of information displayed by the shovel assisting device 50 on the first display device D3 and the second display device D3S will be described. FIG. 6 shows an example of a scene seen by the operator seated on the operator's seat 10S installed in the cabin 10 of the shovel 100 when performing a slope shaping operation. In the example shown in FIG. 6, the slope subject to the slope shaping operation is an ascending slope. In FIG. 6, for clarity, a fine dot pattern patterns a first slope portion FS at the right side where the slope shaping operation has been completed, and a coarse dot pattern patterns a second slope portion US at the left side where the slope shaping operation has not been completed. FIG. 6 shows that a handrail GR is installed on the top of the slope TS. FIG. 6 shows that the first display device D3 is installed on the front side of the right pillar 10R of the cabin 10, and the second display device D3S is installed on the left side of the first display device D3. In the example shown in FIG. 6, the second display device D3S is fixed to the upper end of a pole PL extending from the floor surface. Further, FIG. 6 shows that a left sideview mirror SM is attached to the left side of the left pillar 10L of the cabin 10.

Figure 7:
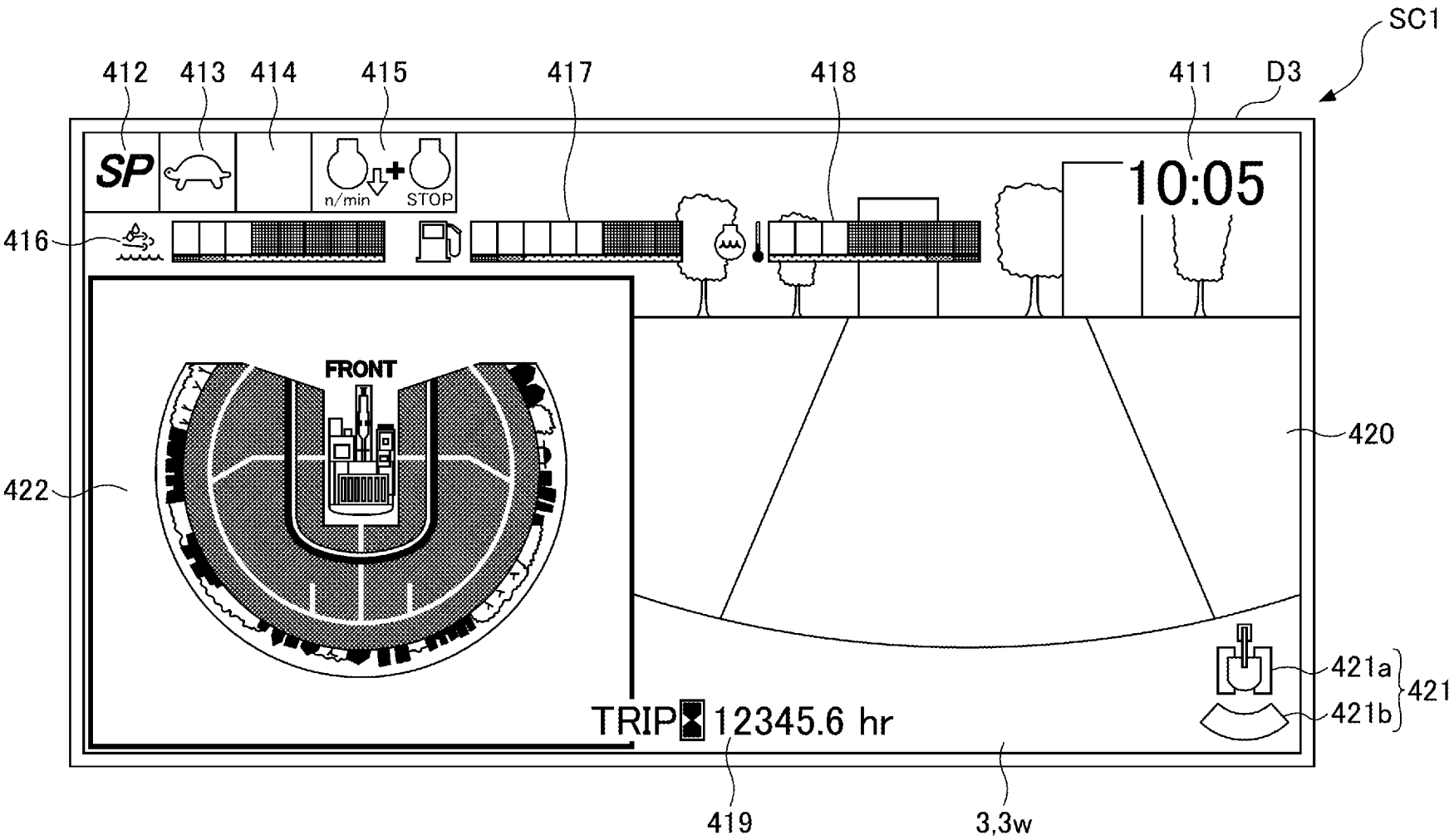
FIG. 7 shows an example of a screen page displayed on a first display device.

FIG. 7 shows an example of a screen page (a screen page SC1) displayed on the first display device D3. The screen page SC1 includes a time display portion 411, a speed mode display portion 412, a traveling mode display portion 413, an attachment display portion 414, an engine control state display portion 415, an urea water remaining amount display portion 416, a fuel remaining amount display portion 417, a cooling water temperature display portion 418, an engine operation time display portion 419, a camera image display portion 420, and a combined image display portion 422. The speed mode display portion 412, the traveling mode display portion 413, the attachment display portion 414, and the engine control state display portion 415 are display portions for displaying information concerning the setting state of the shovel 100. The urea water remaining amount display portion 416, the fuel remaining amount display portion 417, the cooling water temperature display portion 418, and the engine operation time display portion 419 are display portions for displaying information concerning the operating state of the shovel 100. The images displayed in these portions are generated by the first display device D3 using various data transmitted from the shovel assisting device 50 and image data transmitted from the space recognition device S6.

The time display portion 411 displays the current time. The speed mode display portion 412 displays the speed mode set by the engine speed adjustment dial (not shown) as operation information of the shovel 100. The traveling mode display portion 413 displays the traveling mode as operation information of the shovel 100. The traveling mode indicates the setting state of the traveling oil hydraulic motor employing the variable displacement motor. For example, the traveling mode is a low speed mode or a high speed mode, and a mark symbolizing a "turtle" is displayed for the low speed mode, and a mark symbolizing a "rabbit" is displayed for the high speed mode. The attachment display portion 414 is an area for displaying an icon representing the type of attachment currently installed. The engine control state display portion 415 displays the control state of the engine 11 as operation information of the shovel 100. In the example shown in FIG. 7, an "automatic deceleration/automatic stop mode" is selected as the control state of the engine 11. The "automatic deceleration/automatic stop mode" means a control mode of automatically reducing the engine speed and then automatically stopping the engine 11 in accordance with the duration of the non-operation state. Other control states of the engine 11 include an "automatic deceleration mode", an "automatic stop mode", and a "manual deceleration mode".

The urea water remaining amount display portion 416 displays the remaining amount state of the urea water stored in an urea water tank as operation information of the shovel 100. In the example shown in FIG. 7, a bar gauge representing the current remaining amount state of the urea water is displayed at the urea water remaining amount display portion 416. The remaining amount of the urea water is displayed based on the data output from an urea water remaining amount sensor provided in the urea water tank.

The fuel remaining amount display portion 417 displays the remaining amount of fuel stored in the fuel tank as operation information. In the example shown in FIG. 7, the fuel remaining amount display portion 417 displays a bar gauge representing the current remaining amount of fuel.

The remaining amount of fuel is displayed based on the data output from a fuel remaining amount sensor provided in the fuel tank.

The cooling water temperature display portion 418 displays the temperature state of the engine cooling water as operation information of the shovel 100. In the example shown in FIG. 7, the cooling water temperature display portion 418 displays a bar gauge representing the temperature state of the engine cooling water. The temperature of the engine cooling water is displayed based on data output from a water temperature sensor provided in the engine 11.

The engine operation time display portion 419 displays the accumulated operation time of the engine 11 as operation information of the shovel 100. In the example shown in FIG. 7, the accumulated operation time since time counting was restarted by the operator is displayed in the engine operation time display portion 419 together with the unit "hr (hour)". The engine operation time display portion 419 may display the lifetime operation time during the entire period after the shovel manufacturing or the section operation time since time counting was restarted by the operator.

The camera image display portion 420 displays an image captured by the space recognition device S6. In the example shown in FIG. 7, the camera image display portion 420 displays an image captured by the rear space recognition device attached to the rear end of the upper surface of the upper swinging body 3. The camera image display portion 420 may display a camera image captured by the left space recognition device attached to the left end of the upper surface of the upper swinging body 3 or the right space recognition device attached to the right end of the upper surface of the upper swinging body 3. The camera image display portion 420 may display, side by side, camera images captured by a plurality of space recognition devices (cameras) among the left space recognition device, the right space recognition device, and the rear space recognition device.

Each space recognition device (camera) may be installed in such a manner that an image of a part of the upper swinging body 3 is included in the camera image. By including an image of a part of the upper swinging body 3 in the displayed image, the operator can easily understand the sense of distance between the object displayed in the camera image display portion 420 and the shovel 100. In the example shown in FIG. 7, the camera image display portion 420 displays an image of the counterweight 3*w* of the upper swinging body 3.

The camera image display portion 420 displays a FIG. 421 representing the orientation of the space recognition device S6 (the rear space recognition device) that has captured the camera image being displayed. The FIG. 421 includes a shovel FIG. 421*a* representing the shape of the shovel 100 and a band-like direction display FIG. 421*b* representing the image-capturing direction of the space recognition device S6 that has captured the camera image being displayed. The FIG. 421 is a display portion that displays information about the setting state of the shovel 100.

In the example shown in FIG. 7, the direction display FIG. 421*b* is displayed below the shovel FIG. 421*a* (on the side opposite to the figure representing the excavation attachment AT). This indicates that the image behind the shovel 100 captured by the rear space recognition device is displayed in the camera image display portion 420. For example, when the image captured by the right space recognition device is displayed in the camera image display portion 420, the direction display FIG. 421*b* is displayed at the right side of the shovel FIG. 421*a*. When the image captured by the left space recognition device is displayed in the camera image display portion 420, for example, the direction display FIG. 421*b* is displayed at the left side of the shovel FIG. 421*a*.

The operator can, for example, switch the image displayed in the camera image display portion 420 to an image captured by another camera or the like by pressing an image switching switch (not shown) provided in the cabin 10.

The combined image display portion 422 displays a combined image of a plurality of camera images captured by at least two of the plurality of space recognition devices S6 (the left space recognition device, the right space recognition device, and the rear space recognition device). In the example shown in FIG. 7, the combined image display portion 422 displays a bird's eye view image, which is a combined image of three camera images captured by the left space recognition device, the right space recognition device, and the rear space recognition device, so as to surround the left, rear, and right sides of the shovel figure. Note that the combined image display portion 422 may display a bird's eye image, which is a combined image of four camera images captured by the front space recognition device, the left space recognition device, the right space recognition device, and the rear space recognition device, so as to surround the front, left, rear, and right sides of the shovel figure.

Figure 8:
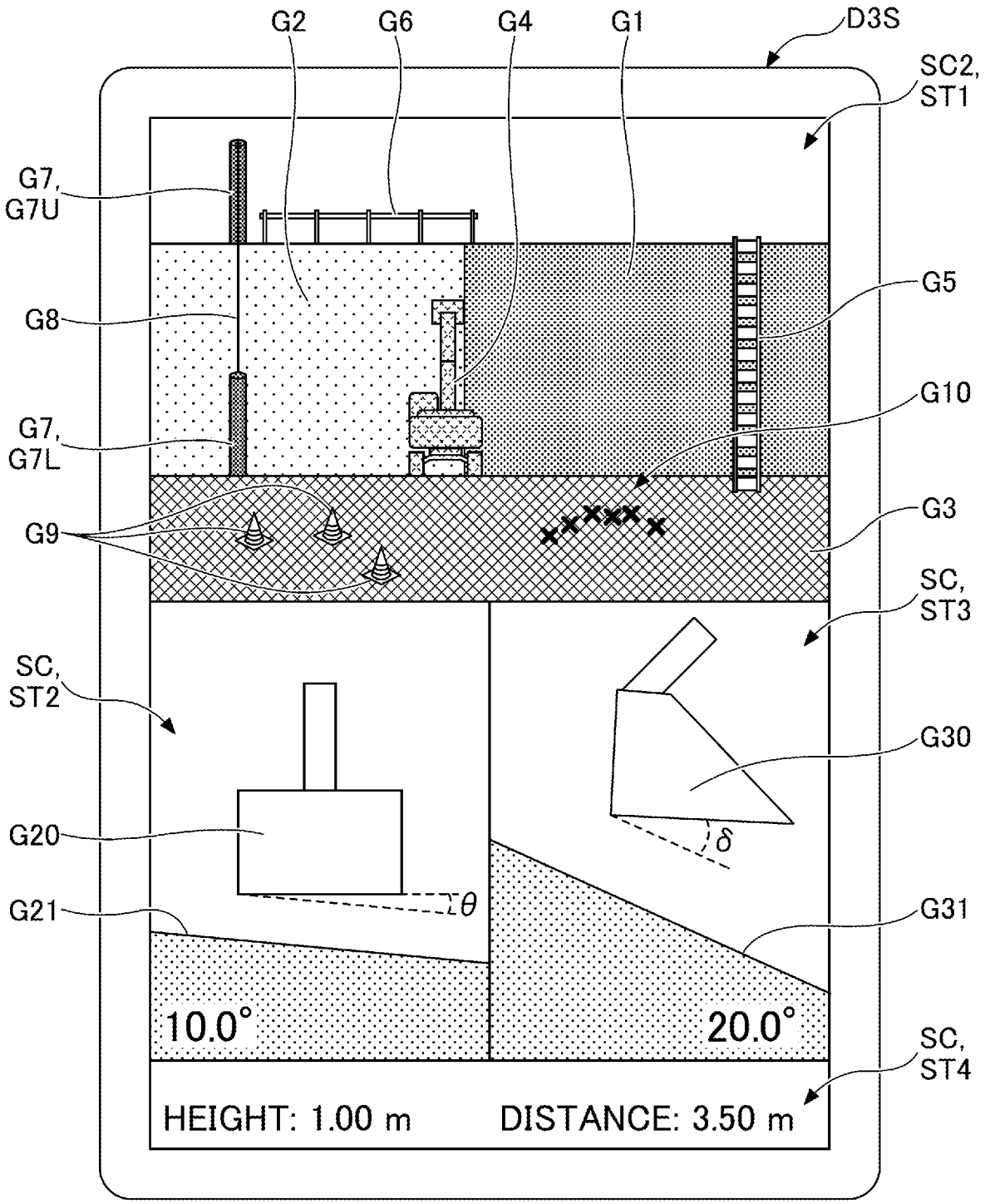
FIG. 8 shows an example of a screen page displayed on a second display device.

FIG. 8 shows an example of a screen page (a screen page SC2) displayed on the second display device D3S. The screen page SC2 includes a first screen page portion ST1, a second screen page portion ST2, a third screen page portion ST3, and a fourth screen page portion ST4.

The first screen page portion ST is a screen page portion at which combined data generated by the combined data generating part 507 is displayed. In the example shown in FIG. 8, the first screen page portion ST1 includes figures G1 to G10. The figure G1 is a figure representing a first slope portion FS for which slope shaping work has been completed. The figure G2 is a figure representing a second slope portion US for which the slope shaping work has not been completed. The figure G3 is a figure representing the ground on which the shovel 100 is located. The figure G4 is a shovel figure representing the shovel 100. The figure G5 is a figure representing makeshift stairs installed on the slope subject to the slope shaping work. The figure G6 is a figure representing a handrail GR installed on the top of the slope TS subject to the slope shaping work. The figure G7 includes figures representing power poles installed at the work site. The figure G7 includes a figure G7U and a figure G7L. The figure G7U is a figure representing a first power pole installed near the top of the slope TS, and the figure G7L is a figure representing a second power pole installed near the foot of the slope. The figure G8 is a figure representing an electric wire between the first electric pole and the second electric pole. The figure G9 is a figure representing a road cone placed on the ground where the shovel 100 is located. The figure G10 is a figure representing an object that exists but has not been identified. The figures G4 to G9 may be icons or three-dimensional models. The three-dimensional models may be generated using texture-mapped polygons. In this case, the texture images may be generated based on the output of the space recognition device S6.

The figures G1 to G4 are rendered based on the three-dimensional design data and the output of the positioning device S8. For example, the determination as to whether a particular slope portion is the first slope portion FS or the second slope portion US is performed based on the information about (the transition of) the position of the shovel 100 in the past. This determination may be performed based on the information about (the transition of) the position of the work portion of the bucket 6 in the past. Alternatively, the determination as to whether a particular slope part is the first slope portion FS or the second slope portion US may be performed based on the output of the camera as the space recognition device S6, that is, by using image recognition processing.

The figures G5 to G9 are rendered based on the feature data acquired by the feature data acquiring part 506, and the figure G10 is rendered based on the object data acquired by the object data acquiring part 509.

The operator can understand that the makeshift stairs are installed at a remote position on the right side by looking at the figure G5 of the first screen page portion ST1, and can understand that the probability of contact between the shovel 100 and the makeshift stairs is low when proceeding with the slope shaping work toward the left side.

Moreover, the operator can understand that the handrail GR is installed on the top of the slope TS of the second slope portion US where the slope shaping work has not been completed, by looking at the figure G6 of the first screen page portion ST1. The operator can confirm with the naked eyes that the handrail GR is also installed on the top TS of the slope, as displayed in the first screen page portion ST1, in the real space (See FIG. 6) in front of the shovel 100 visible through the windshield of the cabin 10.

The operator can also understand that the power pole is installed at a remote position (the position not visible with the naked eyes at present, i.e., not included in the real space ahead (See FIG. 6)) on the left side, by looking at the figure G7 (especially the figure G7L) in the first screen page portion ST1. Then, the operator can understand that there is a high probability that the shovel 100 and the power pole (the second power pole) will come into contact with each other when proceeding with the slope shaping work toward the left side, that is, can understand that caution is required when moving toward the left side.

In addition, the operator can understand that the electric wire has been strung at a remote position on the left side, by looking at the shape G8 of the first screen page portion ST1. Then, the operator can understand that there is a high probability of contact between the excavation attachment and the electric wire when proceeding with the slope shaping work toward the left side, that is, can understand that caution is required when operating the excavation attachment after moving toward the left side.

In addition, the operator can understand that the road cone is placed on ground in a left-rear direction which cannot be confirmed with the naked eyes at present, by looking at the figure G9 of the first screen page portion ST1. That is, even if the operator does not understand what is in the area surrounded by the plurality of road cones, the operator can at least understand that the operator should not enter the area surrounded by the plurality of road cones. The operator can then understand that the shovel 100 may enter the area surrounded by the plurality of road cones when moving in the left-rear direction, that is, can understand that caution is required when moving in the left-rear direction.

The feature data acquiring part 506 can recognize a road cone placed on the ground as a predetermined feature (a road cone) using image recognition processing, but does not recognize a protrusion from the ground having the same height as a road cone as a predetermined feature (a road cone). Therefore, a figure relating to the protrusion from the ground is not displayed in the first screen page portion ST1, and thus, the first screen page portion ST1 is prevented from becoming excessively complicated.

In addition, by looking at the figure G10 of the first screen page portion ST1, the operator can understand that some object exists in the area which is in a right-rear direction and cannot be identified with the naked eyes at present. In addition, the operator can understand the fact that the shovel 100 approached the object within a predetermined period in the past. Then, the operator can understand that there is a high probability that the shovel 100 and the object will come into contact with each other when moving in the right-rear direction, that is, can understand that caution is required when moving in the right-rear direction.

Thus, the operator of the shovel 100 can understand the types and positions of the main features existing around the shovel 100 while viewing the three-dimensional design data by viewing the first screen page portion ST1. Therefore, the operator can proceed with various operations while understanding the existence of those main features, thereby improving the safety in the work site.

The second screen page portion ST2 is an image portion that schematically displays the relationship between the bucket 6 and the target construction surface as guidance data. In the second screen page portion ST2, the bucket 6 and the target construction surface when the operator looks ahead of the shovel while being seated on the operator's seat 10S are schematically displayed as a bucket figure G20 and a target construction surface figure G21. The bucket figure G20 represents the bucket 6 and is represented by the shape of the bucket 6 when the bucket 6 is viewed from the cabin 10. The target construction surface figure G21 represents the ground as the target construction surface and is displayed together with the tilt angle θ (10.0 degrees (°) in the example shown in FIG. 8) of the back surface of the bucket 6 with respect to the target construction surface. Note that an additional line represented by a dashed line with respect to the tilt angle θ in FIG. 8 is not actually displayed. The interval between the bucket figure G20 and the target construction surface figure G21 is displayed so as to vary according to the real distance between the back surface of the bucket 6 and the target construction surface. In the same way, the tilt angle θ of the back surface of the bucket 6 is displayed so to vary according to the real positional relationship between the back surface of the bucket 6 and the target construction surface.

The operator can understand the positional relationship between the bucket 6 and the target construction surface and the tilt angle θ of the back surface of the bucket 6 by looking at the second screen page portion ST2. In order to enhance the operator's visibility, the target construction surface figure G21 may be displayed in the second screen page portion ST2 so that the displayed tilt angle θ appears larger than the actual tilt angle. The operator can understand the approximate magnitude of the tilt angle θ from the target construction surface figure G21 displayed in the second screen page portion ST2. In addition, when the operator wants to know the exact magnitude of the actual tilt angle, the operator can know the magnitude of the actual tilt angle by looking at the value of the tilt angle θ displayed at the lower left corner of the second screen page portion ST2.

The third screen page portion ST3 is a screen page portion which schematically displays the relationship between the bucket 6 and the target construction surface as guidance data. The bucket figure G30 and the target construction surface figure G31 are displayed in the third screen page portion ST3. The bucket figure G30 is a figure representing the bucket 6 and is represented by the shape of the bucket 6 as it appears when the bucket 6 is viewed laterally. The target construction surface figure G31 is displayed together with the tilt angle δ (20.0 degrees (°) in the example shown in FIG. 8) of the back surface of the bucket 6 with respect to the target construction surface. Note that the additional line indicated by the dashed line with respect to the tilt angle δ in FIG. 8 is not actually displayed. The interval between the bucket figure G30 and the target construction surface figure G31 is displayed so as to vary according to the real distance from the back surface of the bucket 6 to the target construction surface. In the same way, the tilt angle δ of the back surface of the bucket 6 is displayed so as to vary according to the real positional relationship between the back surface of the bucket 6 and the target construction surface.

The operator can understand the positional relationship between the back surface of the bucket 6 and the target construction surface and the tilt angle δ of the back surface of the bucket 6 by looking at the third screen page portion ST3. In order to enhance the operator's visibility, the target construction surface figure G31 may be displayed in the third screen page portion ST3 in such a manner that the displayed tilt angle δ appears larger than the real tilt angle. The operator can understand the approximate magnitude of the tilt angle δ from the target construction surface figure G31 displayed in the third screen page portion ST3. In addition, when the operator wants to know the exact magnitude of the real tilt angle, the operator can know the magnitude of the real tilt angle δ by looking at the value of the tilt angle δ displayed at the lower right corner of the third screen page portion ST3.

The fourth screen page portion ST4 is a screen page portion for displaying various numerical values representing the positional relationship between the bucket 6 and the target construction surface as guidance data. In the example shown in FIG. 8, the fourth screen page portion ST4 displays the height of the back surface of the bucket 6 relative to the target construction surface (the vertical distance between the back surface of the bucket 6 and the target construction surface). In the example shown in FIG. 8, the height is 1.00 meters. Further, in the fourth screen page portion ST4, the distance from the swinging axis to the tip of the bucket 6 is displayed. In the example shown in FIG. 8, the distance is 3.5 meters. In the fourth screen page portion ST4, other numerical information such as the swinging angle of the upper swinging body 3 with respect to the reference direction may be displayed.

Figure 9:
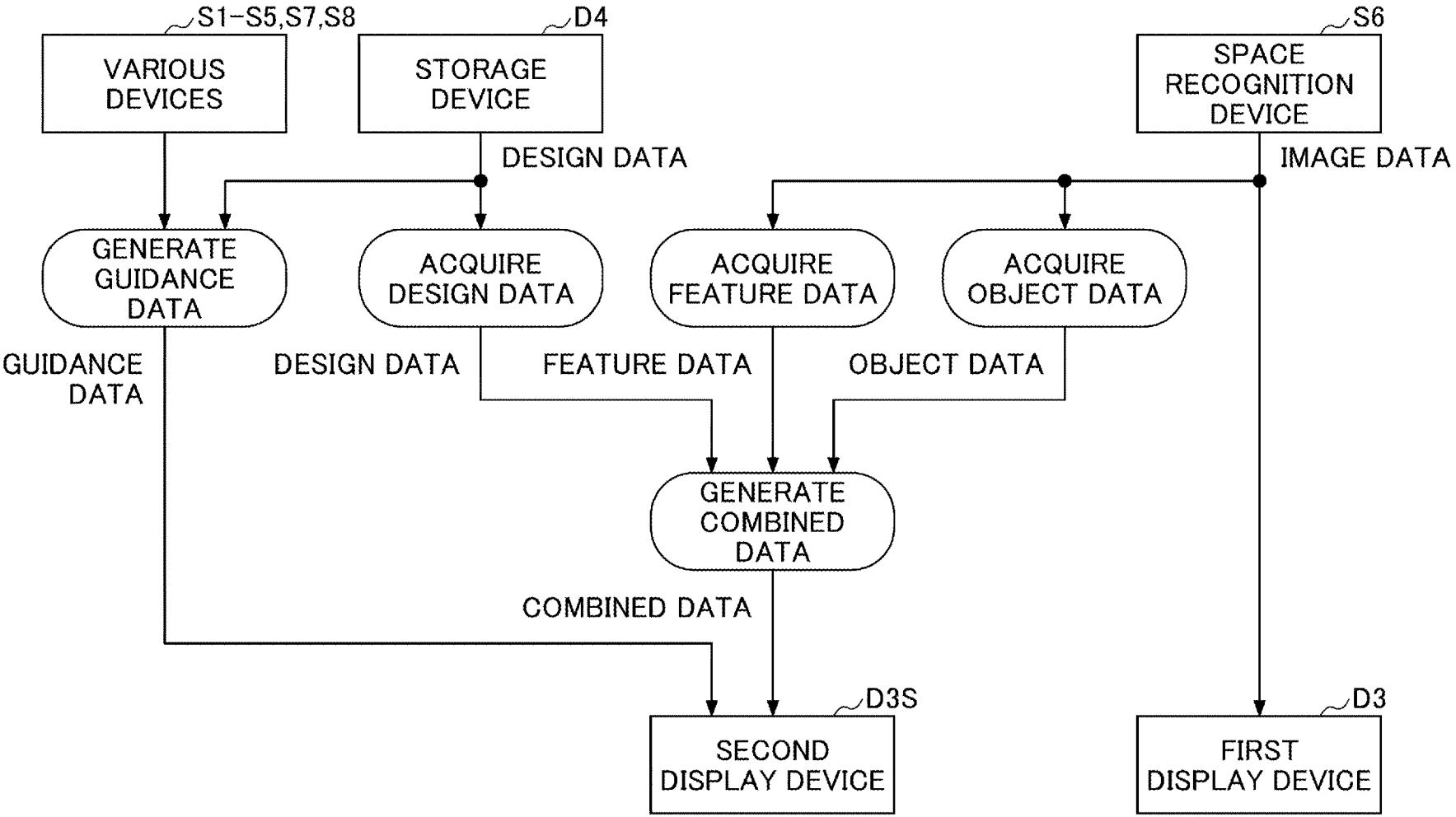
FIG. 9 is a data flow diagram showing an example of a flow of data when the assisting device for the shovel displays information on the display devices.

Next, referring to FIG. 9, the main flow of data when the shovel assisting device 50 displays information on the first display device D3 and the second display device D3S will be described. FIG. 9 is a data flow diagram showing the main flow of data when the shovel assisting device 50 displays information on the first display device D3 and the second display device D3S.

Specifically, the image data acquired by the space recognition device S6 is output to the first display device D3 indirectly via the shovel assisting device 50 or directly without using the shovel assisting device 50. With this configuration, the first display device D3 can display an image generated based on the image data output by at least one of the rear space recognition device, the front space recognition device, the left space recognition device, or the right space recognition device, as shown in FIG. 7.

The shovel assisting device 50 acquires the object data and the feature data based on the image data acquired by the space recognition device S6. The shovel assisting device 50 acquires the design data stored in the storage device D4. Then, the shovel assisting device 50 generates combined data based on the design data, the feature data, and the object data.

Further, the shovel assisting device 50 generates the guidance data based on data acquired by various devices such as the boom angle sensor S1, the arm angle sensor S2, the bucket angle sensor S3, the machine body tilt sensor S4, the swinging angular velocity sensor S5, the communication device S7, and the positioning device S8 mounted on the shovel 100, and the design data stored in the storage device D4.

The combined data and the guidance data generated by the shovel assisting device 50 are output to the second display device D3S. With this configuration, as shown in FIG. 8, the second display device D3S can distinguishably display an object such as an electric wire or road cone recognized by the shovel assisting device 50, or an object such as a worker working around the shovel 100. The recognition result may also be displayed on the first display device D3.

Next, a configuration example of an assisting system SYS of the shovel 100 will be described with reference to FIGS. 10 and 11. FIG. is a schematic diagram showing a configuration example of the assisting system SYS. FIG. 11 is a functional block diagram showing a configuration example of the assisting system SYS.

The assisting system SYS is another example of the assisting device for the shovel, and mainly includes the positioning device 58, the controller 30, a solenoid valve unit 45, a sound collecting device A1, the space recognition device S6, and the communication device S7 mounted on the shovel 100, which is a remote-controlled construction machine (a remote-controlled shovel); the operation sensor 29, a remote controller 80, an indoor image capturing device C2, a sound output device D2, the first display device D3, the second display device D3S, and the communication device T2 installed in a remote control room RC; a controller 90 and a communication device T3 as management devices installed in an information center 200; and an outdoor image capturing device C3 installed in a work site. The position of the outdoor image capturing device C3 may be registered in advance or may be dynamically identified based on the output of a positioning device such as a GNSS receiver attached to the outdoor image capturing device C3. In the present embodiment, the outdoor image capturing device C3 is attached to the tip of a steel tower provided at each of the four corners of the work site so as to capture an image of the entire area of the work site.

Figure 10:
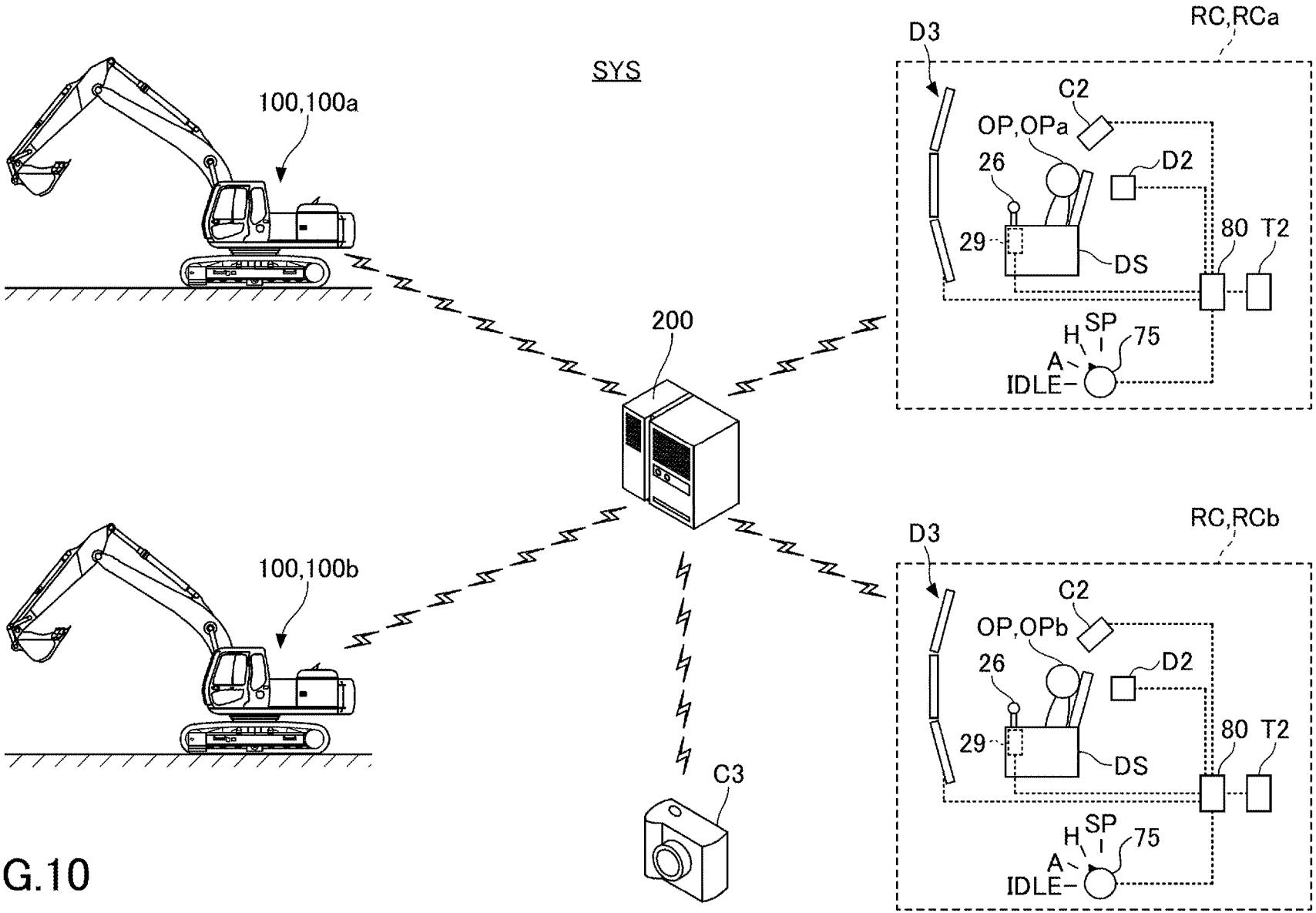
FIG. 10 is a schematic diagram showing an example of a configuration of an assisting system.
Figure 11:
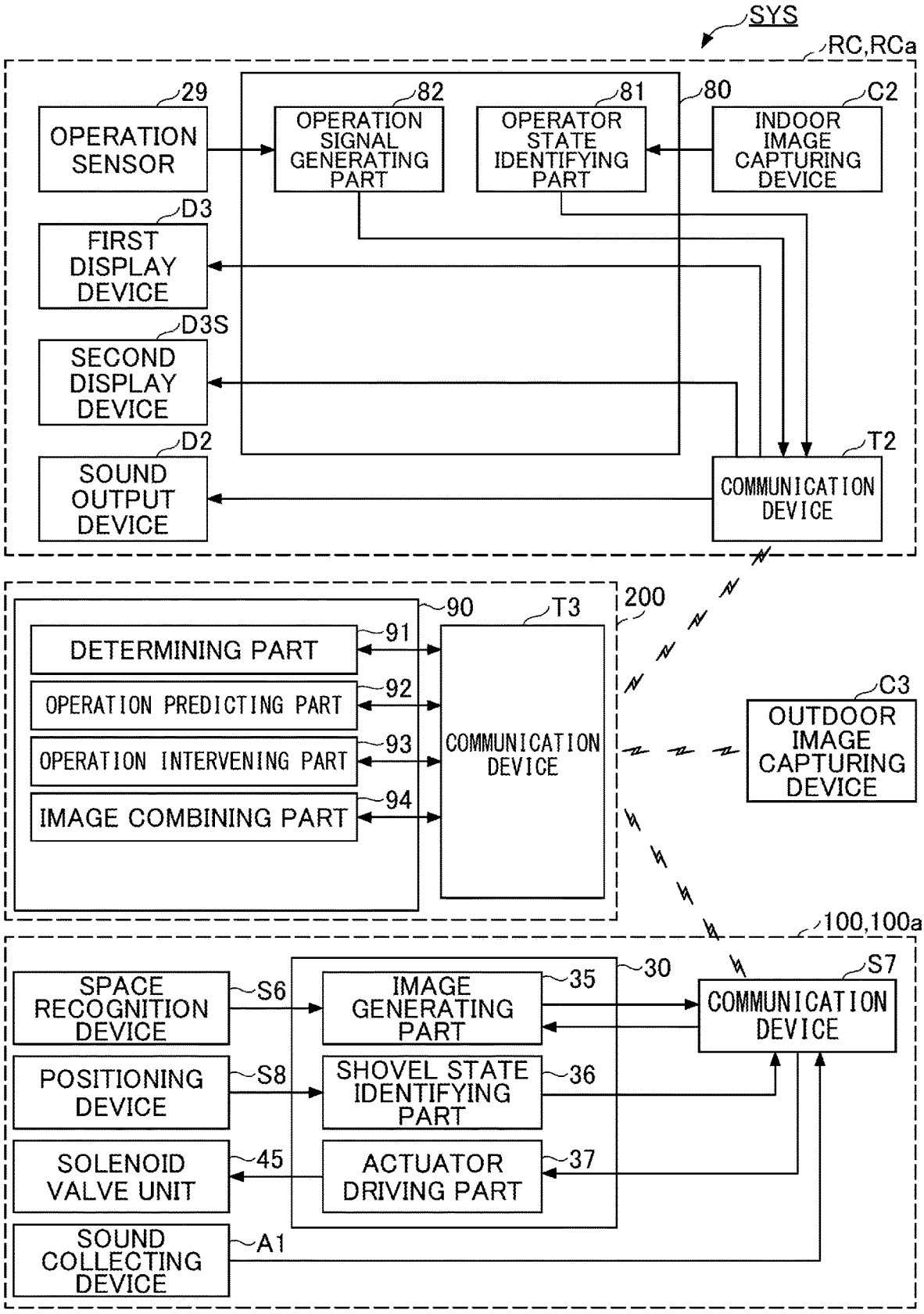
FIG. 11 is a functional block diagram showing an example of a configuration of the assisting system.

In the example shown in FIGS. 10 and 11, functional elements such as the tilt angle calculating part 501, the height calculating part 502, the distance calculating part 503, the operation direction display part 504, the design data acquiring part 505, the feature data acquiring part 506, the combined data generating part 507, the contact avoiding control part 508, the object data acquiring part 509, and the display control part 510 (not shown) are arranged in the controller 90. However, these functional elements may be arranged in the controller 30 or the remote controller 80, and may be distributed to at least two of the controller 30, the remote controller 80, and the controller 30. Some of these functional elements may be mounted in at least one of the space recognition device 56 or the outdoor image capturing device C3. For example, functional elements such as the feature data acquiring part 506 and the object data acquiring part 509 may be mounted in an arithmetic and logic processing unit mounted in each of the space recognition device S6 and the outdoor image capturing device C3.

In the example shown in FIG. 10, the assisting system SYS includes a shovel 100*a*, a shovel 100*b*, a remote control room RCa for the shovel 100*a* (an operator OPa), a remote control room RCb for the shovel 100*b* (an operator OPb), the outdoor image capturing device C3 installed at the work site, and an information center 200.

First, the functions of the controller 30 mounted on the shovel 100*a* will now be described. As shown in FIG. 11, the controller 30 includes an image generating part 35, a shovel state identifying part 36, and an actuator driving part 37 as functional elements. The same applies to the shovel 100*b*.

The image generating part 35 is configured to generate a surrounding image including an image displayed by the first display device D3. The surrounding image is an image that is used when the first display device D3 displays an image. Typically, the surrounding image is an image representing a state of the surroundings of the shovel 100 that the operator could see if the operator were in the cabin 10. In the present embodiment, the surrounding image is generated based on an image captured by the space recognition device S6. Specifically, the image generating part 35 generates a first virtual viewpoint image as the surrounding image based on images captured by the rear space recognition device, the front space recognition device, the left space recognition device, and the right space recognition device. However, the image generating part 35 may generate the first virtual viewpoint image as the surrounding image based on an image captured by at least one of the rear space recognition device, the front space recognition device, the left space recognition device, or the right space recognition device. The first virtual viewpoint, which is a virtual viewpoint with respect to the first virtual viewpoint image, is a virtual operator's viewpoint corresponding to the position of the operator's eyes if the operator were seated on the operator's seat 10S in the cabin 10. However, the virtual operator's viewpoint may be outside the cabin 10.

In the present embodiment, the coordinates of the virtual operator's viewpoint, which is the first virtual viewpoint, are derived based on the operator's viewpoint, which is the position of the eyes of the operator OP when the operator OP is seated on the operator's seat DS of the remote control room RC. The coordinates of the operator's viewpoint are transmitted from the remote controller 80. The image generating part 35 can derive the coordinates of the virtual operator's viewpoint by converting the coordinates of the operator's viewpoint in the control room coordinate system to the coordinates in the shovel coordinate system. However, the coordinates of the operator's viewpoint may have predetermined fixed values.

In the present embodiment, the first virtual viewpoint image corresponds to an image projected on the inner peripheral surface of a cylindrical virtual projection surface surrounding the first virtual viewpoint. The virtual projection surface may be an inner surface of a virtual sphere or hemisphere surrounding the first virtual viewpoint, or an inner surface of another virtual solid such as a virtual rectangular parallelepiped or cube surrounding the first virtual viewpoint. By viewing the first virtual viewpoint image thus generated, the operator OP can acquire a three-dimensional view of the situation surrounding the shovel 100. That is, by viewing the first virtual viewpoint image, the operator OP can more accurately acquire, for example, the depth of the load bed of a dump truck located in front of the shovel 100, the height of a mound on the ground, or the depth of a hole on the ground.

The image displayed by the first display device D3 is a part of the first virtual viewpoint image generated by the image generating part 35. Note that when the first display device D3 is a head-mounted display, the area occupied by the image displayed by the first display device D3 in the entire area of the first virtual viewpoint image, may be determined based on the direction of the line of sight of the operator OP seated on the operator's seat DS of the remote control room RC. In this case, information concerning the direction of the line of sight of the operator OP is transmitted from the remote controller 80. The image generating part 35 generates the first virtual viewpoint image as a surrounding image based on the image output from the space recognition device S6 and the coordinates of the operator's viewpoint transmitted from the remote controller 80. The image generating part 35 then extracts a portion of the generated first virtual viewpoint image as a partial surrounding image based on the information concerning the direction of the line of sight of the operator OP transmitted from the remote controller 80, and transmits the extracted partial surrounding image to the first display device D3 in the remote control room RC.

The shovel state identifying part 36 is configured to identify the state of the shovel 100. In the present embodiment, the state of the shovel 100 includes the position and orientation of the shovel 100. The position of the shovel 100 is, for example, the latitude, longitude, and altitude of the reference point in the shovel 100. The shovel state identifying part 36 identifies the position and orientation of the shovel based on the output of the positioning device S8.

The actuator driving part 37 is configured to drive the actuators mounted on the shovel 100. In the present embodiment, the actuator driving part 37 generates and outputs an operation signal for each of the plurality of solenoid valves included in the solenoid valve unit 45 based on the operation signal transmitted from the remote controller 80.

The solenoid valve unit 45 includes a plurality of solenoid valves arranged in the pilot lines connecting the pilot pump 15 and the pilot ports of the control valves in the control valve unit 17.

In the present embodiment, the controller 30 can control the pilot pressure applied to the pilot port of each control valve by individually controlling the opening area of each of the plurality of solenoid valves. Therefore, the controller 30 can control the flow rate of hydraulic oil flowing into each hydraulic actuator and the flow rate of hydraulic oil flowing out from each hydraulic actuator, which in turn can control the movement of each hydraulic actuator.

In this way, the controller 30 can realize the lifting or lowering of the boom 4, the opening or closing of the arm 5, the opening or closing of the bucket 6, swinging of the upper swinging body 3, or driving the lower traveling body 1 in accordance with an operation signal from the outside such as the remote control room RC.

Each solenoid valve receiving the operation signal increases or decreases the pilot pressure applied to the pilot port of the corresponding control valve in the control valve unit 17. As a result, the oil hydraulic actuator corresponding to each control valve operates at a speed corresponding to the stroke amount of the control valve.

Next, the function of the remote controller 80 installed in the remote control room RC will be described. The remote controller 80 has an operator state identifying part 81 and an operation signal generating part 82 as functional elements.

The operator state identifying part 81 is configured to identify the state of the operator OP in the remote control room RC. The state of the operator OP includes the position of the eyes of the operator OP and the direction of his/her line of sight. The operator state identifying part 81 identifies the eye position and the direction of the line of sight of the operator OP based on the output of the indoor image capturing device C2, which is another example of the space recognition device. Specifically, the operator state identifying part 81 performs various image processing on the image captured by the indoor image capturing device C2, and identifies the coordinates of the eye position of the operator OP in the control room coordinate system as the coordinates of the operator's viewpoint. The operator state identifying part 81 also performs various image processing on the image captured by the indoor image capturing device C2, and identifies the direction of the line of sight of the operator OP in the control room coordinate system.

The operator state identifying part 81 may derive the coordinates of the operator's viewpoint and the direction of the line of sight of the operator OP based on the output of another device than the indoor image capturing device C2, such as a LIDAR installed in the remote control room RC or an inertial measurement device attached to a head-mounted display as the first display device D3. The inertial measurement device may include a positioning device.

The operator state identifying part 81 then transmits information concerning the coordinates of the operator's viewpoint and the direction of the line of sight of the operator OP to the shovel 100 or the information center 200 through the communication device T2.

The operation signal generating part 82 is configured to generate the operation signal. In the present embodiment, the operation signal generating part 82 is configured to generate the operation signal based on the output of the operation sensor 29.

Next, a function of the controller 90 installed in the information center 200 will be described. The controller 90 is an arithmetic and logic unit for executing various kinds of arithmetic and logic operations. In the present embodiment, the controller 90, like the controller and the remote controller 80, includes a microcomputer including a CPU and a memory. The various functions of the controller 90 are realized by the CPU executing programs stored in the memory.

In the present embodiment, the controller 90 includes a determining part 91, an operation predicting part 92, an operation intervening part 93, and an image combining part 94 as functional elements.

The determining part 91 is configured to determine whether there is a matter to be notified to the operator of the shovel 100 with regard to the situation around the shovel 100. In the present embodiment, the determining part 91 is configured to determine whether there is a matter to be notified to the operator of the shovel 100 based on at least one of the image captured by the space recognition device S6 attached to the shovel 100, the position, the attitude, or the operation content of the shovel 100. The determining part 91 may be configured to determine at least one of the position, the attitude, or the operation content of the shovel 100 based on the image captured by the space recognition device S6. The determining part 91 may be configured to determine whether there is a matter to be notified to the operator of the shovel 100 based on the image captured by the outdoor image capturing device C3, which is yet another example of the space recognition device, or based on construction terrain information (terrain data). Further, the determining part 91 may be configured to determine at least one of the position, the attitude, or the operation content of another construction machine based on the image captured by the outdoor image capturing device C3. The determining part 91 may determine whether there is a matter to be notified to the operator of the shovel 100 based on the situation around the shovel 100 derived from the image acquired by the space recognition device S6 and the outdoor image capturing device C3 as well as the position, attitude, and operation content of the shovel 100. Whether or not there is a matter to be notified may be determined based on the existence of the same or similar situation, in light of past cases.

For example, when the determining part 91 detects that there is a person outside the range covered by the image displayed on the first display device D3, the determining part 91 determines that there is a matter to be notified to the operator. For example, when the determining part 91 detects that there is a person in a left-rear direction of the shovel 100, the determining part 91 determines that there is a matter to be notified to the operator. In this case, the determining part 91 may detect the person based on the output of another space recognition device such as a LIDAR, ultrasonic sensor, millimeter-wave radar, or infrared sensor attached to the upper swinging body 3. Alternatively, the determining part 91 may detect the person based on the image captured by the outdoor image capturing device C3 installed at the work site. In this case, the outdoor image capturing device C3 is, for example, a hemi-omnidirectional camera mounted on the tip of a pole installed at the work site. The outdoor image capturing device C3 may be an image capturing device mounted on another work machine or an image capturing device mounted on a flying machine such as a multicopter (drone) flying over the work site. The outdoor image capturing device C3 may be another device such as a LIDAR, an ultrasonic sensor, a millimeter wave radar, or an infrared sensor. The same applies when a human being is detected inside the range covered by the image displayed on the first display device D3.

When the determining part 91 detects the presence of an electric wire outside the range covered by the image displayed on the first display device D3, the determining part 91 may determine that there is a matter to be notified to the operator. For example, when the determining part 91 detects the presence of an electric wire above the shovel 100, the determining part 91 may determine that there is a matter to be notified to the operator. In this case, the determining part 91 may detect the electric wire based on the output of the space recognition device. The determining part 91 may detect the electric wire based on the image captured by the outdoor image capturing device C3. The same applies to a case where an electric wire is detected to exist inside the range covered by the image displayed on the first display device D3.

The determining part 91 determines, based on the construction terrain information (terrain data), that there is a matter to be notified to the operator when a descending slope is detected in front of the shovel 100. For example, the determining part 91 determines that there is a matter to be notified to the operator when a descending slope is detected in front of the shovel 100. In this case, the determining part 91 may detect a descending slope based on the output of the space recognition device. The determining part 91 may detect a descending slope based on the image captured by the outdoor image capturing device C3. The determining part 91 may detect a descending slope based on the construction terrain information (the terrain data) previously stored in a non-volatile storage medium that the controller 90 has or the like.

When having determined that there is a matter to be notified to the operator of the shovel 100, the determining part 91 calls the operator's attention. In the present embodiment, the determining part 91 transmits information about the matter to be notified to the image combining part 94. The image combining part 94 superimposes and displays the image concerning the information received from the determining part 91 on the partial surrounding image.

The operation predicting part 92 is configured to predict the operation signal that will exist after a predetermined time based on the operation signal currently received from the remote controller 80. This is to suppress a reduction in operation responsiveness that would otherwise occur due to a communication delay, that is, a delay until operation by the operator OP in the remote control room RC is reflected in the movement of the shovel 100. The predetermined time is, for example, a few milliseconds to tens of milliseconds. For example, the operation predicting part 92 predicts an operation signal that will exist after the predetermined time based on the transition of an operation signal (the tilt angle of the operation lever) in the past predetermined time. For example, when the operation predicting part 92 detects that the tilt angle of the operation lever has tended to increase in the past predetermined time, the operation predicting part 92 predicts that the tilt angle after the predetermined time will become larger than the current tilt angle.

Instead of transmitting the operation signal received from the remote controller 80 directly to the shovel 100, the operation predicting part 92 transmits the predicted operation signal to the shovel 100.

With this configuration, the operation predicting part 92 can substantially transmit the operation signal generated in the remote control room RC to the shovel 100 without delay.

The operation intervening part 93 is configured to intervene in the operation that is performed by the operator OP in the remote control room RC. In the present embodiment, the determining part 91 is configured to determine whether or not to intervene in the operation that is performed by the operator OP based on the image captured by the space recognition device S6 attached to the shovel 100.

For example, the operation intervening part 93 determines to intervene in the operation that is performed by the operator OP when the operation intervening part 93 detects that there is a risk of contact between the shovel 100 and an object near the shovel 100. For example, the operation intervening part 93 determines to intervene in the operation that is performed by the operator OP when the operation intervening part 93 detects the presence of a person on the left side of the shovel 100 and also detects that the left swinging operation (the operation of tilting the left operation lever to the left) has started. In this case, the operation intervening part 93 invalidates the operation signal generated based on the left swinging operation and prevents the upper swinging body 3 from swinging to the left. Note that the operation intervening part 93 may detect that there is a risk of contact between the shovel 100 and the object near the shovel 100 based on the output of the space recognition device. The determining part 91 may detect that there is a risk of contact between the shovel 100 and the object near the shovel 100 based on the image captured by the outdoor image capturing device C3. The controller 30 may be configured to, when having determined that there is a matter to be notified to the operator accordingly, perform braking control such as stopping or decelerating the shovel 100, based on the operation signal.

Thereafter, the operator may end the braking control such as stopping or decelerating the shovel 100, by performing an operation such as, for example, temporarily returning the operation lever to neutral or pressing an ending button, i.e., by causing an ending condition to be satisfied. The ending condition may be a condition that the shovel 100 is in a stopped state.

The image combining part 94 is configured to combine the partial surrounding image transmitted from the controller 30 and another image to generate the combined image.

The another image may be a design surface image which is an image generated based on design surface information. In the present embodiment, the image combining part 94 superimposes on the partial surrounding image a graphic such as computer graphics representing the position of the design surface as the design surface image based on the design surface information previously stored in a nonvolatile storage device included in the controller 90. The design surface is the ground surface that should appear when excavation work using the shovel 100 has been completed. By looking at the design surface, the operator can understand the surrounding condition of the shovel 100 appearing when the excavation work has been completed, even before the excavation work has been completed. In this case, the image combining part 94 determines the position where the design surface image should be superimposed and displayed in the partial surrounding image based on the position and orientation of the shovel identified by the shovel state identifying part 36.

With the configuration described above, the assisting system SYS enables the operator OP in the remote control room RC to remotely control the shovel 100 that is at a remote location. In doing so, the assisting system SYS enables the operator OP to view in real time the surrounding image generated based on the image captured by the space recognition device S6 attached to the shovel 100. Specifically, the assisting system SYS may display a part of the surrounding image generated based mainly on the image captured by the space recognition device S6 on a multi-display as the first display device D3. The assisting system SYS may display a part of the surrounding image generated based mainly on the image captured by the space recognition device S6 on a head-mounted display as the first display device D3 worn by the operator OP. When the operator OP sees the image displayed by the first display device D3, he/she can acquire a feeling as if he/she is actually operating the shovel 100 in the cabin 10. When the virtual operator's viewpoint is located outside the cabin 10, for example, at a position several meters ahead of the cabin 10, the operator OP may acquire a feeling as if he/she is actually operating the shovel 100 in the immediate vicinity of the bucket 6 outside the cabin 10.

The assisting system SYS may be configured to identify the position of the eyes of the operator OP and the orientation of his/her face (line of sight) based on the image captured by the indoor image capturing device C2 installed in the remote control room RC. The assisting system SYS may be configured to change the content of an image displayed on the head-mounted display as the first display device D3 in accordance with a change in the position of the eyes of the operator OP and the orientation of his/her face (line of sight). Specifically, the assisting system SYS may be configured to determine which area of the first virtual viewpoint image should be displayed in accordance with the change in the position of the eyes of the operator OP and the orientation of his/her face (line of sight). Therefore, the operator OP can view the image in the desired direction by simply turning his/her face in the desired direction.

Figure 12:
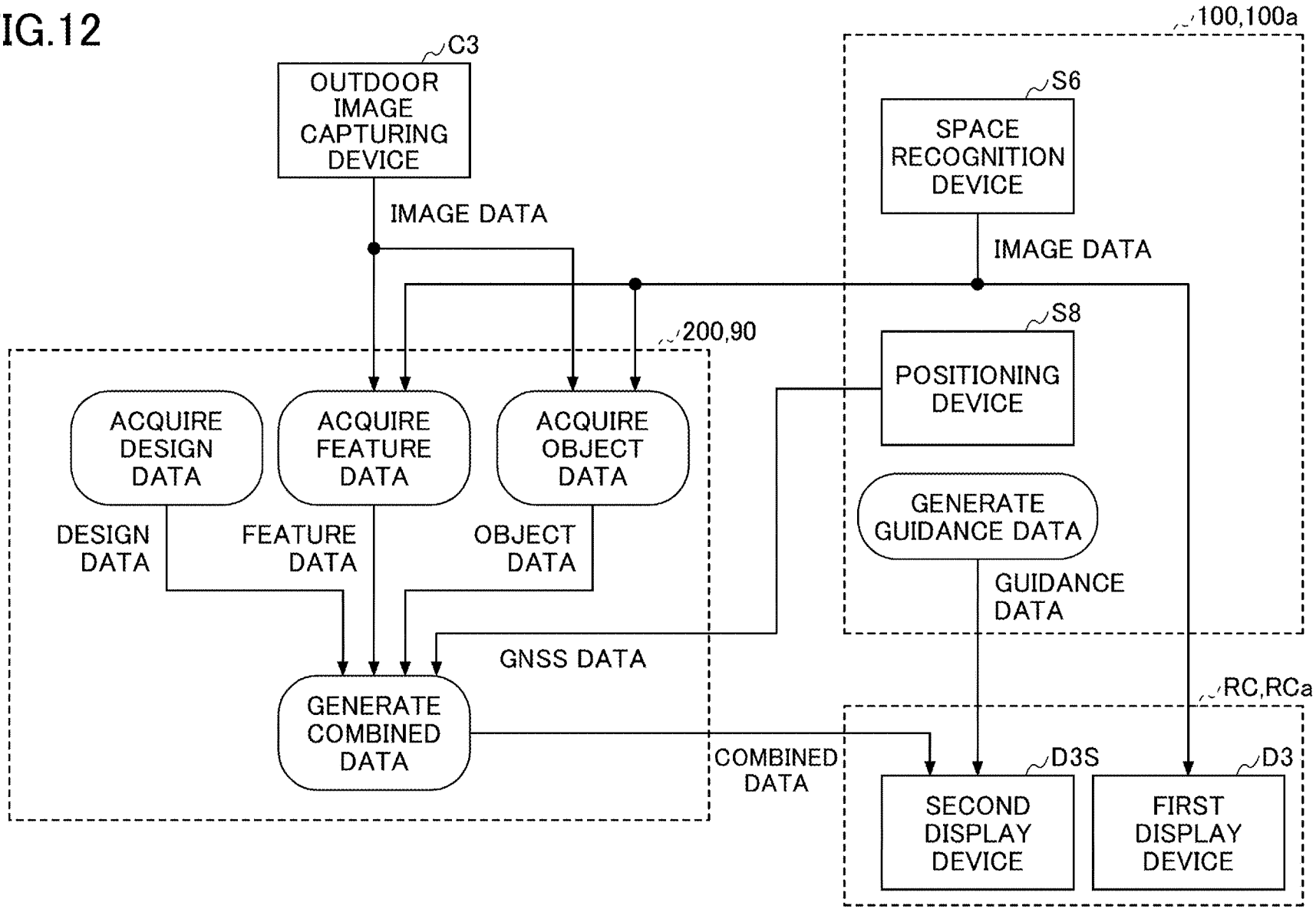
FIG. 12 is a data flow diagram showing an example of data flow when the assisting system displays information on the display devices.

Next, referring to FIG. 12, the main flow of data when the assisting system SYS displays information on the first display device D3 and the second display device D3S will be described. FIG. 12 is a data flow diagram showing the main flow of data when the assisting system SYS displays information on the first display device D3 and the second display device D3S.

Specifically, the image data acquired by the space recognition device S6 attached to the shovel 100*a* is transmitted indirectly through the information center 200 or directly to the first display device D3 installed in the remote control room RCa without using the information center 200. With this configuration, the first display device D3 can display the image generated based on the image data output by at least one of the rear space recognition device, the front space recognition device, the left space recognition device, or the right space recognition device.

The controller 90 installed in the information center 200 acquires the object data and the feature data based on the image data acquired by at least one of the outdoor image capturing device C3 installed at the work site or the space recognition device S6 attached to the shovel 100*a*. The controller 90 acquires the design data stored in the storage device. The controller 90 acquires the GNSS data output by the positioning device S8 mounted on the shovel 100*a*. Then, the controller 90 generates the combined data based on the design data, the feature data, the object data, and the GNSS data.

The controller 30 mounted on the shovel 100*a* generates the guidance data based on the design data and the data acquired by the various devices mounted on the shovel 100*a*, such as the boom angle sensor S1, the arm angle sensor S2, the bucket angle sensor S3, the machine body tilt sensor S4, the swinging angular velocity sensor S5, the communication device S7, and the positioning device S8. The design data may be design data stored in the storage device D4 mounted on the shovel 100*a* or stored in the storage device installed in the information center 200.

The combined data thus generated by the controller 90 and the guidance data thus generated by the controller 30 are transmitted to the second display device D3S installed in the remote control room RCa. With this configuration, the second display device D3S can distinguishably display the feature such as an electric wire or a road cone recognized by the controller 90, or the object such as a worker working around the shovel 100, as shown in FIG. 8. Such recognition results may also be displayed on the first display device D3.

Figure 13:
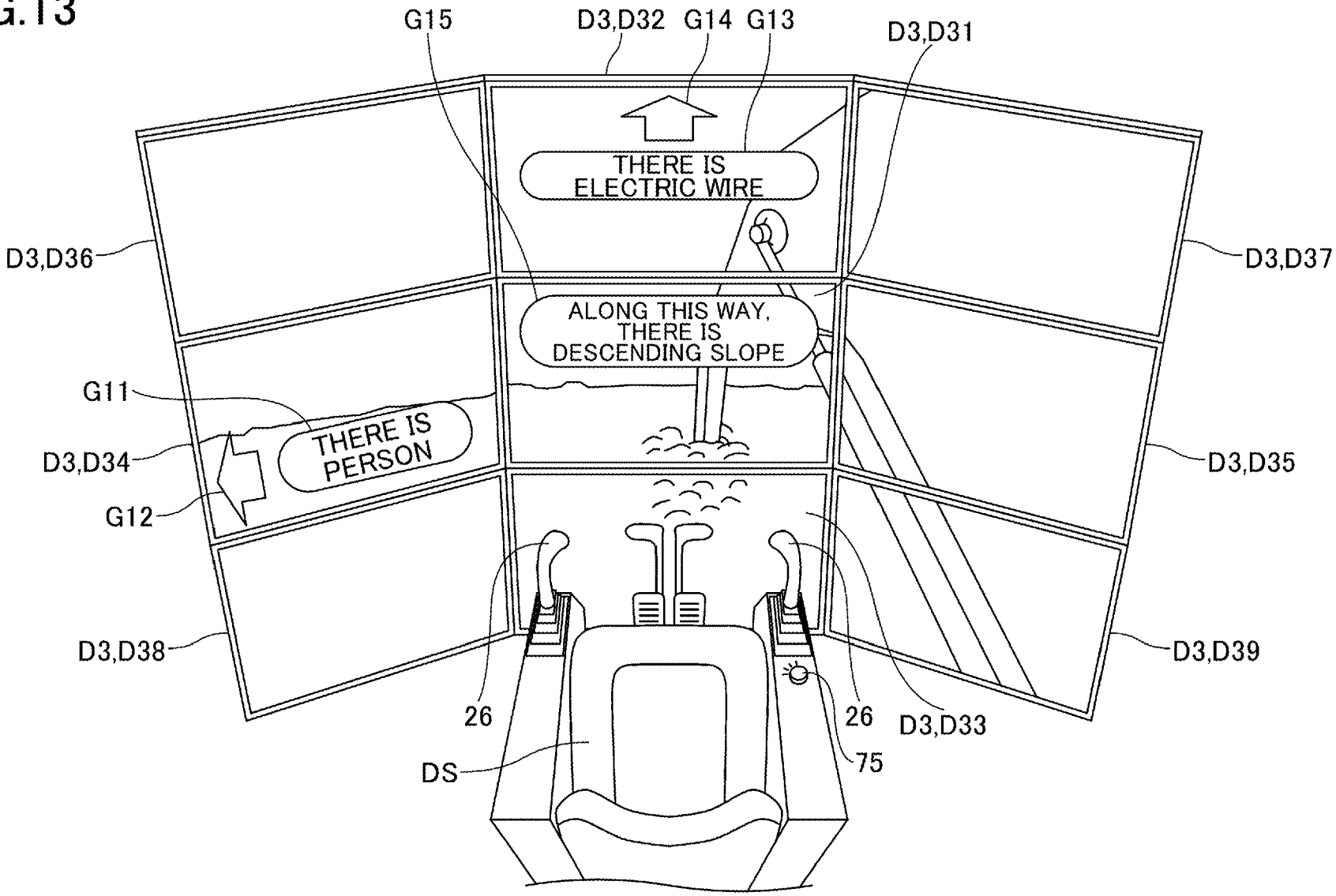
FIG. 13 is a diagram showing another example of a screen page displayed on the first display device.

Next, another example of a screen page displayed on the first display device D3 will be described with reference to FIG. 13. FIG. 13 shows another example of a screen page displayed on the first display device D3. The first display device D3 is a multi-display including nine monitors. The nine monitors include a central monitor D31, an upper monitor D32, a lower monitor D33, a left monitor D34, a right monitor D35, an upper left monitor D36, an upper right monitor D37, a lower left monitor D38, and a lower right monitor D39.

In the example shown in FIG. 13, the screen page displayed on the first display device D3 includes figures G11 to G15. Figures G11 to G15 are images that the image combining part 94, which has received information from the determining part 91 of the controller 90, superimposes on the partial surrounding image.

The figures G11 and G12 are displayed when the determining part 91 detects the presence of a person in a left-rear direction of the shovel 100. The figure G11 is a text box containing a text message for informing the operator OP of the shovel 100 that there is a person near the shovel 100 as "a matter to be notified to the operator". However, the figure G11 may be an icon for informing the operator OP that there is a person near the shovel 100. The figure G12 is an arrow for informing the operator OP that the detected person is present in the left-rear direction of the shovel 100.

The figures G13 and G14 are displayed when the determining part 91 detects that an electric wire exists above the shovel 100. The figure G13 is a text box including a text message for informing the operator OP of the shovel 100 that an electric wire exists above the shovel 100 as "a matter to be notified to the operator". However, the figure G13 may be an icon for informing the operator OP that an electric wire exists above the shovel 100. The figure G14 is an arrow for informing the operator OP that the detected electric wire exists above the shovel 100. If the image displayed on the first display device D3 includes an image of an object to be paid attention to, such as an image of an electric wire, the image of the object may be highlighted by a frame image or the like.

The figure G15 is displayed when the determining part 91 detects that a descending slope exists in front of the shovel 100. The figure G15 is a text box containing a text message for informing the operator OP of the shovel 100 that a descending slope exists in front of the shovel 100 as "a matter to be notified to the operator". However, the figure G15 may be an icon for informing the operator OP that a descending slope exists in front of the shovel 100.

Thus, the assisting system SYS can reliably show the operator OP environmental information that is difficult to understand only from the partial surrounding image displayed on the first display device D3. That is, the assisting system SYS can call the attention of the operator OP to the environmental information that is difficult to understand only from the partial surrounding image displayed on the first display device D3. Specific examples of the environmental information include, for example, the presence of a person in a left-rear direction of the shovel 100, the presence of an electric wire above the shovel 100, and the fact that there is a descending slope in front of the shovel 100.

It should be noted that the assisting system SYS may be configured to reliably transmit the operation information to the operator OP that is difficult to understand only from the partial surrounding image displayed on the first display device D3. That is, the assisting system SYS may be configured to display the operation information superimposed on the partial surrounding image. The specific examples of the operation information include, for example, a noise level and a mechanical vibration level. In this case, the determining part 91 may detect the noise level based on the output of the sound collecting device A1 attached to the upper swinging body 3. The determining part 91 may detect the mechanical vibration level based on the output of a vibration sensor (not shown) attached to the upper swinging body 3. When the noise level exceeds a predetermined threshold, for example, the determining part 91 superimposes and displays information about the noise level on the partial surrounding image. The same applies to the mechanical vibration level.

In addition, the assisting system SYS may be configured to reliably transmit operator information to the operator OP. The operator information include, for example, information about the operator OP. The specific examples of the information about the operator OP include, for example, information about fatigue of the operator OP, information about the physical condition of the operator OP, information about whether the operator OP left the operator's seat DS, and information about the behavior of the operator OP. The specific examples of the information about the behavior of the operator OP include information about whether the operator OP is napping and information about whether the operator OP is looking away. In this case, the determining part 91 acquires information about the operator OP based on the image captured by the indoor image capturing device C2 as an information acquiring part installed in the remote control room RC. When the determining part 91 detects, for example, that the fatigue level of the operator OP is high, the determination part 91 displays a predetermined icon or the like on the first display device D3 to alert the operator OP, and then displays a message urging the operator OP to take a break.

The operator information may be information about another operator. In this case, the determining part 91 acquires information about another operator based on the image captured by the indoor image capturing device C2 installed in another remote control room RC. When the determining part 91 detects, for example, that another operator left the operator's seat DS, the determining part 91 shows the fact to the operator OP.

Figure 14:
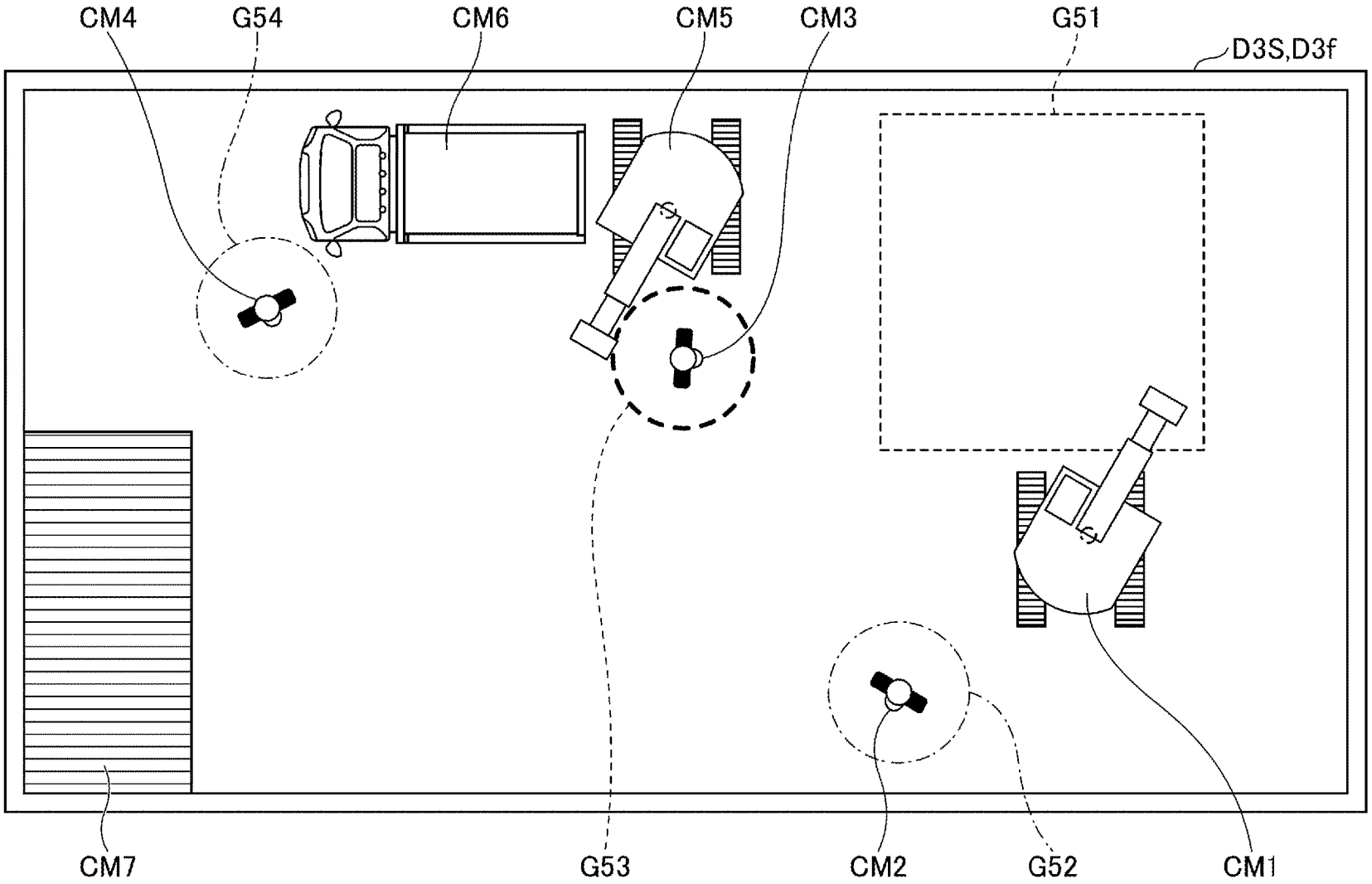
FIG. 14 shows another example of a screen page displayed on the second display device.

Next, another example of a screen page displayed on the second display device D3S will be described with reference to FIG. 14. FIG. 14 shows another example of a screen page displayed on the second display device D3S. The screen page shown in FIG. 14 is generated by the flow of data shown in FIG. 12 and is displayed on the upper left monitor D36 of the first display device D3, which is the multi-display including the nine monitors shown in FIG. 13. That is, the second display device D3S forms a part of the first display device D3. However, the second display device D3S may be a display separate from the first display device D3 and installed in the remote control room RC.

Specifically, the screen page displayed on the second display device D3S includes an image based on the combined data. The combined data is generated by the combined data generating part 507 implemented in the controller 90 by combining the design data showing the position information related to the construction site and the feature data. More specifically, the combined data generating part 507 is configured to generate the combined data by combining the design data acquired by the design data acquiring part 505 and the feature data acquired by the feature data acquiring part 506. In addition, the combined data generating part 507 may integrate the feature data, which is information concerning the range (location) where the predetermined feature exists identified by the feature data acquiring part 506, as part of the design data.

The combined data generating part 507 is configured to associate respective sets of image data, separately received from the plurality of space recognition devices, with respect to information concerning the times (e.g., image capturing times). Specifically, the outdoor image capturing device C3 and the space recognition device S6 each transmit the information concerning the times of acquiring (capturing) the corresponding sets of image data to the outside in association with the corresponding sets of image data. The combined data generating part 507 is configured to then generate the combined data while associating at least one of the object data or the feature data acquired from the image data captured by the outdoor image capturing device C3 at a first time with at least one of the object data or the feature data acquired from the image data captured by the space recognition device S6 at the same first time. That is, the plurality of sets of data such as the object data and the feature data for generating the combined data are generated based on the corresponding sets of image data acquired at the same time. This is in order to reproduce the state of the work site at any time even when there are a plurality of sources of the sets of image data.

Further, the combined data generating part 507 may be configured to generate the combined data by combining the terrain data indicating the position information related to the construction site and the feature data. The terrain data may be acquired by recognizing the construction site by a space recognition device installed outside the shovel 100. For example, the terrain data of the construction site may be acquired by a space recognition device (for example, a camera or a LIDAR, etc.) mounted on a flying machine such as a drone.

The display control part 510 implemented in the controller 90 may display a pre-registered icon at the position of the predetermined feature in the virtual space represented by the three-dimensional design data (i.e., the position corresponding to the position where the predetermined feature is located in the real space). For example, the display control part 510 may display an icon representing the shovel at the position of the shovel in the virtual space represented by the three-dimensional design data. The display control part 510 may display the three-dimensional model of the predetermined feature at the position of the predetermined feature in the virtual space represented by the three-dimensional design data. For example, the display control part 510 may display the three-dimensional model representing the dump truck at the position of the dump truck in the virtual space represented by the three-dimensional design data.

The screen page displayed on the second display device D3S may be a camera image, may be a three-dimensional model, an icon, or the like, or may be a mixture of a camera image with a three-dimensional model, an icon, and the like. For example, the screen page displayed on the second display device D3S may be generated in such a manner that the camera image of the worker or the shovel and the three-dimensional model or icon of the dump truck are mixed therein, or the three-dimensional model or icon of the worker and the camera image of the shovel or the dump truck are mixed therein.

In the illustrated example, the screen page shown in FIG. 14 includes camera images CM1 to CM7 and figures G51 to G54. The camera images CM1 to CM7 are images generated based on image data acquired by the space recognition device S6 attached to the shovel 100 and image data acquired by the outdoor image capturing device C3 installed at the work site. In the present embodiment, the assisting system SYS (the controller 90 installed in the information center 200) is configured to receive image data from each of the space recognition device S6 and the outdoor image capturing device C3, as shown in FIG. 12. The figures G51 to G54 are figures generated by the assisting system SYS (the controller 90 installed in the information center 200).

Specifically, the camera image CM1 is an image of the shovel 100*a* excavating the ground of the construction target area, and the camera image CM2 is an image of a first worker near the shovel 100*a*. The camera image CM3 is an image of a second worker near the shovel 100*b* carrying out the work of loading earth and sand into the bed of the dump truck, and the camera image CM4 is an image of a third worker near the dump truck. The camera image CM5 is an image of the shovel 100*b*, the camera image CM6 is an image of the dump truck, and the camera image CM7 is an image of a slope provided near the entrance of the work site.

The camera images CM1 to CM7 may be replaced with images such as computer graphics stored in the assisting system SYS (the controller 90 installed in the information center 200) as described above. In this case, the type and display position of each of these images is determined based on the feature data or the object data. In the present embodiment, the assisting system SYS (the controller 90 installed in the information center 200) is configured to acquire the feature data and the object data based on the image data received from the space recognition device S6 and the outdoor image capturing device C3, as shown in FIG. 12.

The figure G51 is a dashed line rectangle representing the width of the construction target area and is generated based on the design data. In the present embodiment, the design data is stored in the memory of the controller 90 as shown in FIG. 12. The figure G52 is a dash-dot line circle indicating that the first worker is recognized by the assisting system SYS. The figure G53 is a dashed line circle indicating that the second worker is recognized by the assisting system SYS and that the second worker is within a predetermined area (a warning event). The figure G54 is a dash-dot line circle indicating that the third worker is recognized by the assisting system SYS. The predetermined area is a pre-set area, for example, a circular area centered on the swinging axis of the shovel 100*b* and having the swinging radius as the radius thereof. That is, whether or not a warning event is occurring may be determined according to the distance from the shovel 100*b*. However, the predetermined area may be an area set independently of the position of the shovel 100*b*.

Whether or not a warning event is occurring may be determined according to the type of the object within the predetermined area. For example, in the illustrated example, it is not a warning event that the dump truck is within the predetermined area (the circular area around the swinging axis of the shovel 100*b* and having the radius as the swinging radius). This is because the dump truck needs to be located within the predetermined area when the loading operation is performed. In addition, temporarily placed materials (for example, cray pipes, etc.), equipment installed at the construction site (for example, road cones, etc.), or installations (power poles, a work shed, electric wires, etc.) may be determined as objects that may cause warning events, in the same way as workers. In this case, the priority order of designating an object to cause a warning event may be predetermined according to the type of the object detected. For example, if a worker exists at the same place as a temporarily placed material, it is determined that a warning event is occurring with respect to the worker. If equipment is installed near an installation, it may be determined that a warning event is occurring with respect to the installation. Thus, it may be determined that a warning event is occurring with respect to a worker with the highest priority, and it may be determined that a warning event is occurring with respect to a material and an installation with the second highest priority.

In the illustrated example, the assisting system SYS is configured to make the line types (the dash-dot lines) of the figure G52 surrounding the first worker and the figure G54 surrounding the third worker different from the line type (the thick dashed line) of the figure G53 surrounding the second worker so that a person looking at the screen page can easily notice that a warning event is occurring with respect to the second worker.

Further, when the assisting system SYS recognizes a warning event, the assisting system SYS may announce the event to the surroundings and may notify the relevant person of the occurrence of the warning event. For example, when the assisting system SYS recognizes that the second worker is within the operating radius of the shovel 100*b* as a warning event, the assisting system SYS may notify at least one of the operator of the shovel 100*b* or the second worker of the occurrence of the warning event. In this case, the assisting system SYS may output a warning command to a mobile terminal such as a smartphone carried by the second worker. The mobile terminal which has received the warning command can notify the person who carries the mobile terminal of the occurrence of the warning event by starting an alarm or vibration. Alternatively, the assisting system SYS may output the warning command to the remote controller 80 installed in the remote control room RCb. Upon receiving the warning command, the remote controller 80 can notify the operator of the shovel 100*b* of the occurrence of the warning event by starting an output of warning through a room alarm installed in the remote control room RCb. Alternatively, the assisting system SYS may output the warning command to the controller 30 installed in the shovel 100*b*. Upon receiving the warning command, the controller 30 may start an output of warning through an outdoor alarm attached to the shovel 100*b*, thereby informing the surrounding worker (the second worker) of the occurrence of the warning event.

Figure 15:
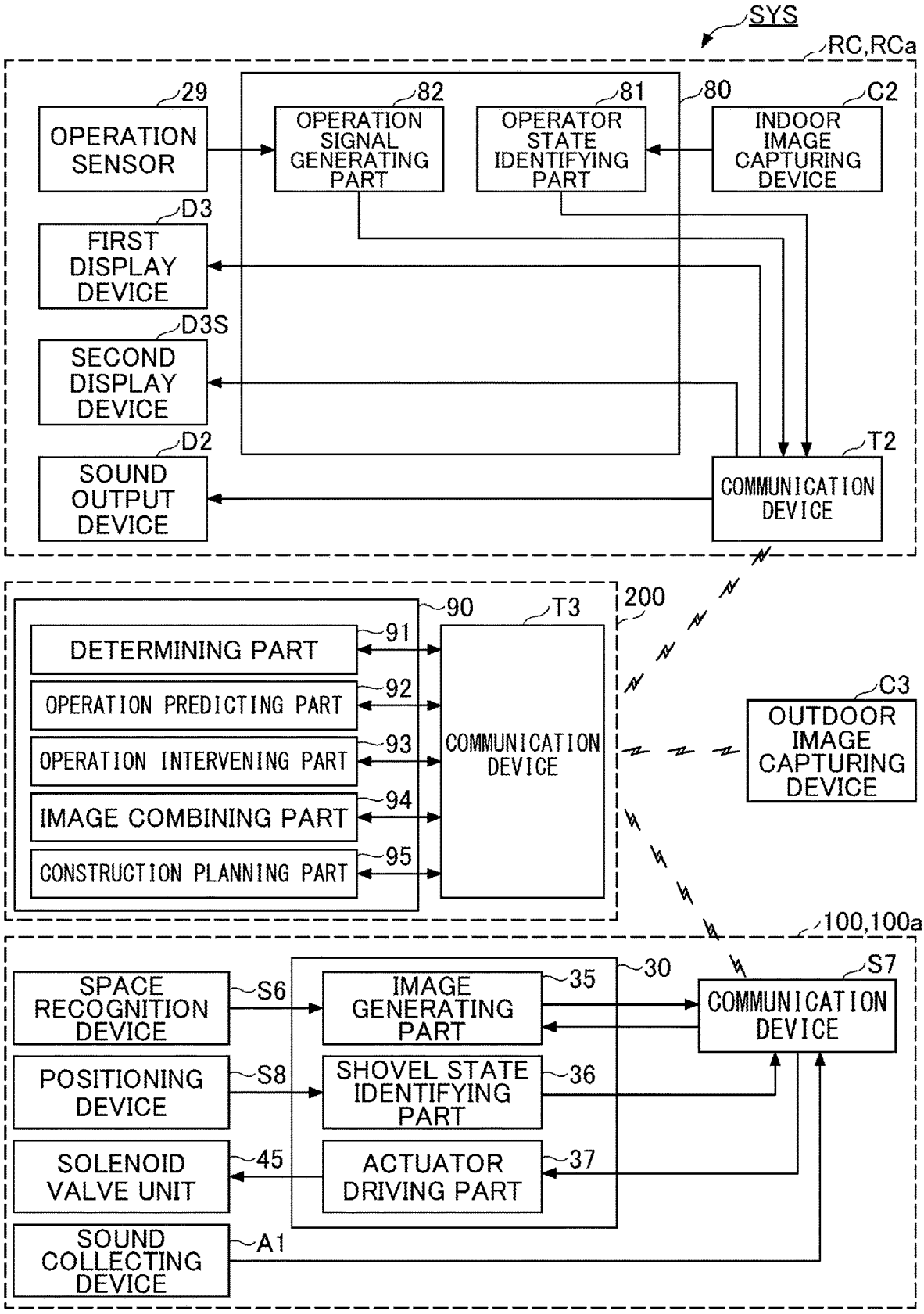
FIG. 15 is a functional block diagram showing another example of the assisting system configuration.

Next, another configuration example of the assisting system SYS of the shovel 100 will be described with reference to FIG. 15. FIG. 15 is a functional block diagram showing another configuration example of the assisting system SYS.

The assisting system SYS shown in FIG. differs from the assisting system SYS shown in FIG. 11 in that the controller 90 installed in the information center 200 includes a construction planning part 95, and is otherwise the same as the assisting system SYS shown in FIG. 11.

The construction planning part 95 generates the operation signal based on construction plan data and transmits the generated operation signal to one or more autonomous construction machines (autonomous shovels). In the illustrated example, the construction plan data is data related to the construction procedure.

Specifically, the construction planning part 95 transmits the operation signal generated based on the construction plan data to the shovel 100*a* as an autonomous shovel (unmanned shovel). The shovel 100*a* operates in response to the operation signal generated by the construction planning part 95 of the controller 90, rather than the operation signal generated by the operation signal generating part 82 of the remote controller 80 installed in the remote control room RCa.

Note that the assisting system SYS shown in FIG. 15 may include an autonomous shovel and a non-autonomous shovel such as the shovel 100 shown in FIG. 10, may include only one or more autonomous shovels, or may include only one or more non-autonomous shovels.

Figure 16:
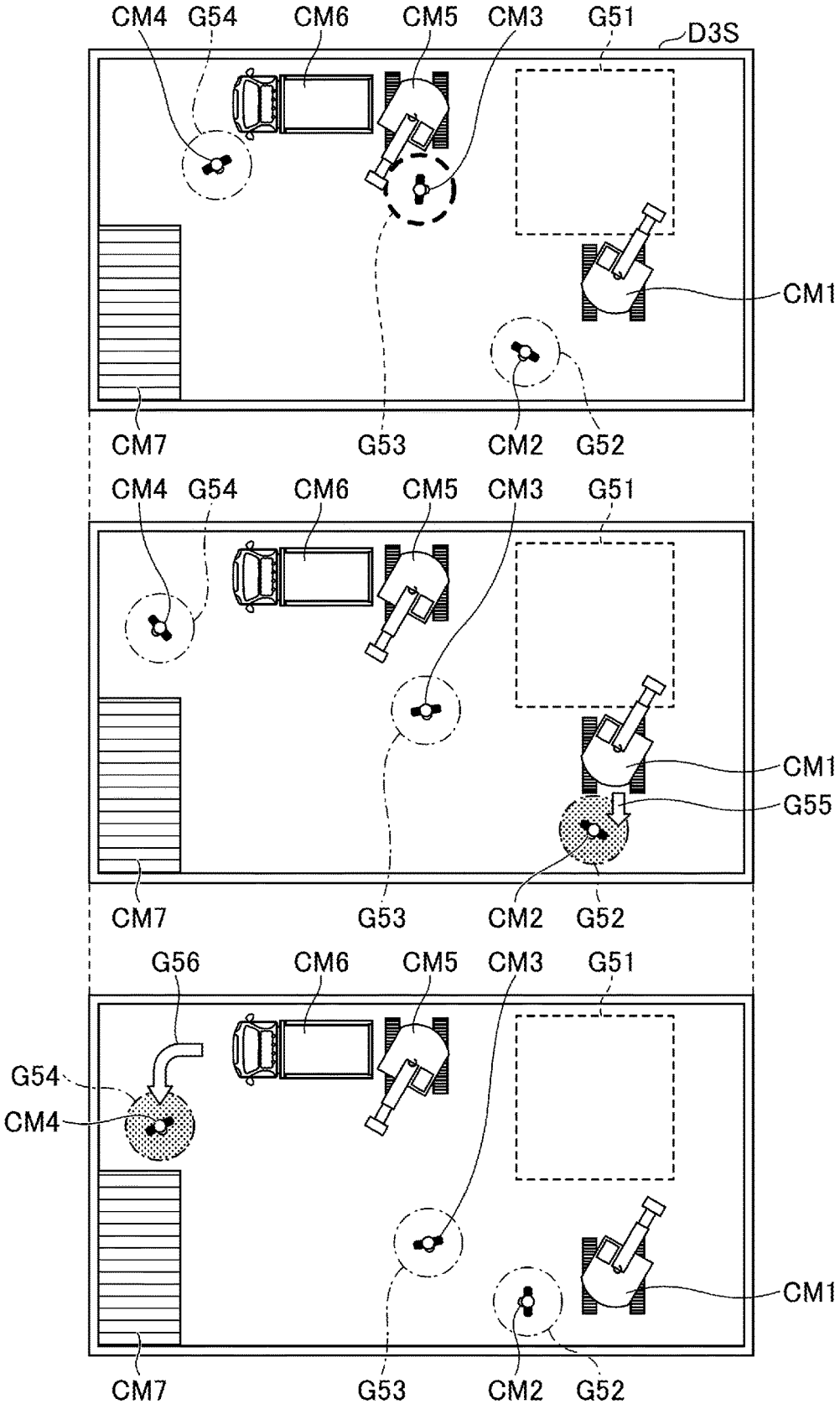
FIG. 16 is a diagram showing yet another example of a screen page displayed on the second display device.

Referring now to FIG. 16, a further example of a screen page displayed on the second display device D3S will be described. FIG. 16 shows screen pages each of which is displayed on the second display device D3S at a corresponding one of three different time points. Specifically, the upper portion of FIG. 16 shows a screen page displayed on the second display device D3S at a first time point; the middle portion of FIG. 16 shows a screen page displayed on the second display device D3S at a second time point after the first time point; and the lower portion of FIG. 16 shows a screen page displayed on the second display device D3S at a third time point after the second time point. The upper portion of FIG. 16 is the same as that of FIG. 14. In the example shown in FIG. 16, the two shovels are both autonomous shovels and operate according to the schedule that is in accordance with the construction plan data. In the example shown in FIG. 16, one dump truck is an autonomous transport vehicle (unmanned dump truck) and operates according to the schedule that is in accordance with the construction plan data.

At the first time point, first to third workers are recognized by the assisting system SYS, as represented by the figures G52 to G54 in the upper portion of FIG. 16. Also, as represented by the figure G53, it is recognized by the assisting system SYS that the second worker is within the operating radius of the shovel 100*b* (a first warning event).

A person who has seen the screen page displayed on the second display device D3S at the first time point can visually understand that the three workers are recognized by the assisting system SYS and that the first warning event is occurring.

When the assisting system SYS recognizes that the second worker is within the operating radius of the shovel 100*b*, the assisting system SYS may output a warning command to the mobile terminal carried by the second worker and inform the second worker of this fact. Alternatively, the assisting system SYS may output the warning command to the shovel 100*b* and cause the outdoor alarm attached to the shovel 100*b* to start an output of warning, and inform the second worker of this fact.

At the second time point, the first to third workers are recognized by the assisting system SYS, as represented by the figures G52 to G54 in the middle portion of FIG. 16. Also, as represented by the figures G52 and G55, it is recognized by the assisting system SYS that the first worker is in a scheduled course of the shovel 100*a*, which is scheduled to move backward after a predetermined time (e.g., after 30 seconds) (a second warning event). The figure G55 is an arrow indicating that the shovel 100*a*, which is an autonomous shovel, is to move backward, and is generated based on the construction plan data.

A person who has seen the screen page displayed on the second display device D3S at the second time point can visually understand that three workers are recognized by the assisting system SYS, that the second warning event is occurring, and that the first warning event has ended.

When the assisting system SYS recognizes that the first worker is in the scheduled course of the shovel 100*a*, the assisting system SYS may output a warning command to the mobile terminal carried by the first worker to inform the first worker of the fact. Alternatively, the assisting system SYS may output the warning command to the shovel 100*a* to initiate an output of a warning by an outdoor alarm attached to the shovel 100*a* to inform the first worker of the fact.

At the third time point, the first to third workers are recognized by the assisting system SYS as represented by the figures G52 to G54 in the lower portion of FIG. 16. Also, as represented by the figures G54 and G56, it is recognized by the assisting system SYS that the third worker is in a scheduled course of the dump truck that is scheduled to move forward after a predetermined time (e.g., 30 seconds) (a third warning event). The figure G56 is an arrow indicating that the dump truck, which is an autonomous transport vehicle, is scheduled to move forward, and is generated based on the construction plan data. Thus, the assisting system SYS may determine presence or absence of a warning event with respect to a worker or the like on the basis of a state (position information after a predetermined time) of the feature data after the predetermined time generated based on the construction plan data. Thus, the assisting system SYS can further improve the safety of the work site. FIG. 16 shows an example of determining the existence of the warning event with respect to the worker, but the object that may cause the warning event is not limited to a worker. For example, when the position of a temporarily placed material (for example, a cray pipe, etc.) is on the scheduled course of a transport machine (for example, a dump truck, etc.) or a construction machine (For example, a shovel, etc.), the assisting system SYS may determine that a warning event is occurring with respect to the temporarily placed material. For example, when the position of equipment (for example, a road cone, etc.) installed at the construction site is on the scheduled course of a transport machine (for example, a dump truck, etc.) or a construction machine (for example, a shovel, etc.), the assisting system SYS may determine that a warning event is occurring with respect to the temporarily placed material.

A person who has seen the screen page displayed on the second display device D3S at the third time point can visually understand that three workers have been recognized by the assisting system SYS, that the third warning event is occurring, and that the second warning event has ended.

When the assisting system SYS recognizes that the third worker is in the scheduled course of the dump truck, the assisting system SYS may output a warning command to the mobile terminal carried by the third worker and inform the third worker of this fact. Alternatively, the assisting system SYS may output the warning command to the dump truck and cause an outdoor alarm attached to the dump truck to start an output of an alarm, and thus, inform the third worker of this fact.

In the present embodiment, the second display device D3S is a display device installed in the remote control room RC, but the second display device D3S may be a display device installed in the cabin 10 of the shovel 100, may be a display device installed in the information center 200, or may be a display device installed in the mobile terminal carried by the operator of the shovel 100, the superintendent of the information center 200, or the worker working around the shovel 100. The same applies to the first display device D3.

As described above, the shovel assisting device 50 for assisting work performed by the shovel 100 according to the embodiment of the present disclosure includes a design data acquiring part 505 configured to acquire three-dimensional design data, a feature data acquiring part 506 configured to acquire feature data that is data concerning a position of a predetermined feature existing near the shovel 100, and a combined data generating part 507 configured to generate combined data by combining the three-dimensional design data and the feature data.

With this configuration, the shovel assisting device 50 can promote further effective use of the three-dimensional design data. For example, as shown in FIG. 8, the operator of the shovel 100 can efficiently proceed with the work while visualizing the three-dimensional design data because the combined data including the three-dimensional design data and the feature data is displayed on the second display device D3S. That is, the operator need not frequently take his or her eyes off the second display device D3S on which the three-dimensional design data is displayed in order to check the surrounding situation with his or her naked eyes.

The shovel assisting device 50 may be provided with a contact avoiding control part 508 configured to execute control for avoiding contact between the predetermined feature and the shovel 100 based on the combined data.

With this configuration, the shovel assisting device 50 can avoid contact between the predetermined feature and the shovel 100. In this regard, the feature data is not included in the design data in advance, and is data concerning the predetermined feature that actually exists at the present time. Therefore, the predetermined feature data can be used as reliable data even if the position of the predetermined feature has changed due to a natural disaster such as an earthquake or heavy rain, or due to some reason such as relocation, removal, or burning down of the predetermined feature. Therefore, when the feature data is used by the contact avoiding control part 508, a positional shift of the predetermined feature does not become a problem.

The shovel assisting device 50 may be provided with an object data acquiring part 509 configured to acquire object data which is data concerning a position of an object existing near the shovel 100. In this case, the object data acquiring part 509 may be configured to acquire data concerning the position of the object as the object data when the distance between the object and the shovel 100 becomes a predetermined distance or less. The combining data generating part 507 may combine the object data with the three-dimensional design data.

The feature data may be updated at a predetermined timing. For example, the feature data acquiring part 506 may erase the previously acquired feature data at a time when daily work starts. The feature data acquiring part 506 may erase the feature data for which a predetermined period has elapsed from the time of acquisition. The display control part 510 may be configured to display the feature data for which a predetermined period has elapsed from the time of acquisition and the feature data for which a predetermined period has not elapsed from the time of acquisition in such a manner that it is possible to distinguish therebetween.

The shovel assisting device 50 may include the display control part 510 configured to display the combined data on the display device. In this case, the display control part 510 may display a pre-registered icon at the position of the predetermined feature in the virtual space represented by the three-dimensional design data. For example, as shown in FIG. 8, the display control part 510 may display an icon representing a road cone at a position of the road cone in the virtual space represented by the three-dimensional design data. The display control part 510 may display a three-dimensional model of the predetermined feature at the position of the predetermined feature in the virtual space represented by the three-dimensional design data. For example, as shown in FIG. 8, the display control part 510 may display a three-dimensional model representing makeshift stairs at the position of the makeshift stairs in the virtual space represented by the three-dimensional design data.

The shovel assisting device 50 may include the display control part 510 configured to display the combined data generated by the combined data generating part 507 on the second display device D3S different from the first display device D3 on which the image data acquired by the space recognition device S6 is displayed.

The desirable embodiments of the present invention have been described in detail. However, the present invention is not limited to the embodiments described above, nor is it limited to embodiments described below. The embodiments described above or described below may be subject to various modifications, substitutions, etc., without departing from the scope of the present invention. In addition, the features described separately may be combined as long as no technical inconsistencies occur.

For example, in the embodiments described above, the shovel 100 is a manned shovel operated with the use of the manual operation device 26 located in the cabin 10, but may be a remotely operated unmanned shovel or may be an autonomously operating unmanned shovel.

In the above-described embodiments, the shovel assisting device 50 is mounted on the shovel 100, but may be installed outside the shovel 100. In this case, the shovel assisting device 50 may be configured to exchange information with a device mounted on the shovel 100 such as the positioning device S8 or the second display device D3S via a communication device.

In the above-described embodiments, the shovel assisting device 50 is configured to perform control to avoid contact between a predetermined feature and the shovel 100 based on the combined data, but this control may be omitted. That is, the contact avoiding control part 508 may be omitted.

The feature data acquiring part 506 may be provided in a management device connected to the shovel 100 via a communication network. In this case, the shovel 100 may transmit image data acquired by the space recognition device S6 to the management device. The management device may identify the type of the feature, the positional relationship between the feature and the shovel 100, or the location of the feature in the construction site based on the received image data. The management device may transmit the feature data to the shovel assisting device of the shovel 100 or another shovel operating in the same construction site as that of the shovel 100. Thereafter, the shovel assisting device in the shovel 100 or another shovel may generate the combined data and display the combined data on a display device. The management device itself may generate the combined data. In this case, even in a shovel equipped only with a receiver and a display device, the operator of the shovel can understand the positional relationship between the features at the construction site and the target construction surface.

Furthermore, the management device may be provided with an assisting device for a shovel. The display device in the management device may display the combined data. Thus, even if the position of the feature is changed in the construction site, the superintendent can share information concerning the change of the position of the feature with the operator of the shovel by displaying thereof in the management device. Thus, the superintendent can appropriately change the construction setup or change the construction process accordingly.

In the above-described embodiments, the shovel assisting device 50 is mounted on the shovel 100 provided with the space recognition device S6, but may be mounted on a shovel not provided with the space recognition device S6. In this case, the feature data acquiring part 506 may be configured to acquire the feature data based on a camera image captured by a camera installed outside the shovel 100. Also the object data acquiring part 509 may be omitted.

In addition, although the above-described embodiments show the oil hydraulic shovel as an example of a construction machine, the above-described embodiments may also be applied to another construction machine such as a wheel loader or a bulldozer.

DESCRIPTION OF SIGNS

1 . . . Lower traveling body
2 . . . Swinging mechanism
2A . . . Swinging oil hydraulic motor
2M . . . Traveling oil hydraulic motor
2ML . . . Left traveling oil hydraulic motor
2MR . . . Right traveling oil hydraulic motor
3 . . . Upper swinging body
4 . . . Boom
5 . . . Arm

6 . . . Bucket
7 . . . Boom cylinder
8 . . . Arm cylinder
9 . . . Bucket cylinder
10 . . . Cabin
10L . . . Left pillar
10R . . . Right pillar
10S . . . Operator's seat
11 . . . Engine
11*a* . . . Alternator
11*b* . . . Starter
11*c* . . . Water temperature sensor
13 . . . Regulator
13L . . . Left regulator
13R . . . Right regulator
14 . . . Main pump
14L . . . Left main pump
14R . . . Right main pump
14*b* . . . Discharge pressure sensor
14*c* . . . Oil temperature sensor
15 . . . Pilot pump
17 . . . Control valve unit
18L . . . Left choke
18R . . . Right choke
19L . . . Left control pressure sensor
19R . . . Right control pressure sensor
26 . . . Manual operation device
26A . . . Boom operation lever
26B . . . Arm operation lever
28L . . . Left discharge pressure sensor
28R . . . Right discharge pressure sensor
29 . . . Operation sensor
30 . . . Controller
30*a* . . . Temporary storage part
31, 31AL, 31AR, 31BL, 31BR . . . Proportional valves
35 . . . Image generating part
36 . . . Shovel state identifying part
37 . . . Actuator driving part
40L . . . Left center bypass pipe line
40R . . . Right center bypass pipe line
42L . . . Left parallel pipe line
42R . . . Right parallel pipe line
45 . . . Solenoid valve unit
50 . . . Shovel assisting device
55 . . . Fuel storage part
55*a* . . . Fuel storage amount detecting part
61 . . . Limit switch
63 . . . Lock state detecting sensor
70 . . . Storage battery
72 . . . Electrical equipment
75 . . . Engine speed adjustment dial
80 . . . Remote controller
81 . . . Operator state identifying part
82 . . . Operation signal generating part
90 . . . Controller
91 . . . Determining part
92 . . . Operation predicting part
93 . . . Operation intervening part
94 . . . Image combining part
95 . . . Construction planning part
100, 100*a*, 100*b* . . . Shovels
171-176 . . . Control valves
200 . . . Information center
501 . . . Tilt angle calculating part
502 . . . Height calculating part
503 . . . Distance calculating part
504 . . . Operation direction displaying part
505 . . . Design data acquiring part
506 . . . Feature data acquiring part
507 . . . Combined data generating part
508 . . . Contact avoiding control part
509 . . . Object data acquiring part
510 . . . Display control part
A1 . . . Sound collecting part
C2 . . . Indoor image capturing device
C3 . . . Outdoor image capturing device
D1 . . . Input device
D2 . . . Sound output device
D3 . . . First display device
D3S . . . Second display device
D3*a*, D3Sa . . . Conversion processing devices
D4 . . . Storage device
D5 . . . Gate lock lever
D6 . . . Gate lock valve
D7 . . . Engine controller unit
DS . . . Operator's seat
FS . . . First slope portion
GR . . . Handrail
OP, OPa, OPb . . . Operators
PL . . . Pole
RC, RCa, RCb . . . Remote control rooms
S1 . . . Boom angle sensor
S2 . . . Arm angle sensor
S3 . . . Bucket angle sensor
S4 . . . Machine body tilt sensor
S5 . . . Swinging angular velocity sensor
S6 . . . Space recognition device
S7 . . . Communication device
S8 . . . Positioning device
SYS . . . Assisting system
T2, T3 . . . Communication devices
SM . . . Left sideview mirror
TS . . . Top of slope
US . . . Second slope portion

What is claimed is:

1. An assisting device for a construction machine, the assisting device comprising:

a processor configured to determine whether a predetermined feature exists at a construction site, using an output from a sensor and information previously registered in the processor as one or more predetermined features;

acquire feature data which is data concerning a position of the predetermined feature in response to determining that the predetermined feature exists at the construction site;

acquire object data, which is data concerning a position of an object existing near the construction machine, upon a distance between the object and the construction machine becoming less than or equal to a predetermined distance, the object not being identified as one of the one or more predetermined features;

associate position information with respect to the construction site with the feature data and the object data to generate combined data; and control the construction machine to avoid the construction machine coming into contact with the predetermined feature based on the combined data.

2. The assisting device as claimed in claim 1, wherein:

the predetermined feature is a completed part of construction that is a part for which construction has been completed; a handrail installed at a top of a slope that is a target of slope shaping work; or makeshift stairs, a wall, an electric wire, a road cone, or a building installed on the slope that is the target of the slope shaping work.

3. The assisting device as claimed in claim 1, wherein:

the feature data is updated at a predetermined time.

4. The assisting device as claimed in claim 1, wherein:

the processor is further configured to display the combined data on a display, and display a pre-registered icon at a position of the predetermined feature in a virtual space represented by design data or topographic data.

5. The assisting device as claimed in claim 1, wherein:

the processor is further configured to display the combined data on a display, and display a model of the predetermined feature at a position of the predetermined feature in a virtual space represented by design data or topographic data.

6. The assisting device as claimed in claim 1, wherein:

the processor is further configured to display the combined data on a display different from a display on which image data acquired by the sensor is displayed.

7. The assisting device as claimed in claim 1, wherein:

the construction machine is a remote-controlled construction machine.

8. The assisting device as claimed in claim 1, wherein:

the construction machine is an autonomous construction machine.

9. The assisting device as claimed in claim 1, wherein the processor is further configured to suppress or stop a movement of a hydraulic actuator of the construction machine to avoid the construction machine coming into contact with the predetermined feature.

10. The assisting device as claimed in claim 1, wherein the position information with respect to the construction site is determined in a World Geodetic System.

11. The assisting device as claimed in claim 1, wherein the processor is further configured to determine whether the predetermined feature exists by applying an image recognition process to image data acquired by the sensor.

12. The assisting device as claimed in claim 1, wherein the processor is further configured to determine whether the predetermined feature exists based on information on past work of the construction machine when the predetermined feature is a completed part of construction.

13. The assisting device as claimed in claim 1, wherein the processor is further configured to acquire the object data in response to determining that a height of the object is greater than or equal to a predetermined height, upon the distance between the object and the construction machine becoming less than or equal to the predetermined distance.

14. A construction machine, comprising:

a lower traveling body;

an upper swinging body swingably mounted on the lower traveling body; and a processor configured to determine whether a predetermined feature exists at a construction site, using an output from a sensor and information previously registered in the processor as one or more predetermined features;

acquire feature data which is data concerning a position of the predetermined feature in response to determining that the predetermined feature exists at the construction site;

acquire object data, which is data concerning a position of an object existing near the construction machine, upon a distance between the object and the construction machine becoming less than or equal to a predetermined distance, the object not being identified as one of the one or more predetermined features;

associate position information with respect to the construction site with the feature data and the object data to generate combined data; and control the construction machine to avoid the construction machine coming into contact with the predetermined feature based on the combined data.

15. The construction machine as claimed in claim 14, wherein:

the processor is further configured to display the combined data on a display, and display a pre-registered icon at a position of the predetermined feature in a virtual space represented by design data or topographic data.

16. The construction machine as claimed in claim 14, wherein:

the processor is further configured to display the combined data on a display, and display a model of the predetermined feature at a position of the predetermined feature in a virtual space represented by design data or topographic data.

17. The construction machine as claimed in claim 14, wherein the position information with respect to the construction site is determined in a World Geodetic System.

18. The construction machine as claimed in claim 14, wherein the processor is further configured to determine whether the predetermined feature exists by applying an image recognition process to image data acquired by the sensor.

19. The construction machine as claimed in claim 14, wherein the processor is further configured to determine whether the predetermined feature exists based on information on past work of the construction machine when the predetermined feature is a completed part of construction.

20. The construction machine as claimed in claim 14, wherein the processor is further configured to acquire the object data in response to determining that a height of the object is greater than or equal to a predetermined height, upon the distance between the object and the construction machine becoming less than or equal to the predetermined distance.

* * * * *